US006066375A

United States Patent [19]

Shanton

[11] Patent Number: 6,066,375

[45] Date of Patent: May 23, 2000

[54] COATED PAPERBOARD AND PAPERBOARD CONTAINERS HAVING A MICROWAVE INTERACTIVE LAYER WHICH EMITS NONE OR VERY LOW AMOUNTS OF BENZENE IN MICROWAVE APPLICATIONS

[75] Inventor: Kenneth J. Shanton, Neenah, Wis.

[73] Assignee: Fort James Corporation, Deerfield, Ill.

[21] Appl. No.: 08/835,700

[22] Filed: Apr. 10, 1997

[51] Int. Cl.[7] ..... C08K 3/08

[52] U.S. Cl. ..... 428/35.7; 428/34.2; 428/35.3

[58] Field of Search ..... 428/34.2, 35.3

[56] References Cited

U.S. PATENT DOCUMENTS

| | | | |
|---|---|---|---|
| 4,518,768 | 5/1985 | Scheurer et al. | 528/483 |
| 4,721,500 | 1/1988 | Van Handel et al. | 493/152 |
| 4,900,809 | 2/1990 | Tazi et al. | 528/497 |
| 4,962,185 | 10/1990 | Tazi et al. | 528/497 |
| 4,992,517 | 2/1991 | Tazi et al. | 526/209 |
| 5,049,714 | 9/1991 | Beresniewicz et al. . | |
| 5,079,083 | 1/1992 | Watkins et al. . | |
| 5,118,747 | 6/1992 | Pollart et al. . | |
| 5,231,269 | 7/1993 | Oku et al. . | |
| 5,278,377 | 1/1994 | Tsai . | |
| 5,308,945 | 5/1994 | VanHandel et al . | |
| 5,338,911 | 8/1994 | Brandbert et al. . | |
| 5,349,168 | 9/1994 | Wilen . | |

*Primary Examiner*—Charles Nold

[57] ABSTRACT

An improved, coated microwaveable paperboard or container useful for forming substantially rigid food containers such as plates, bowls, trays and the like and a process from producing the improved, coated paperboard is provided. The microwaveable paperboard and food containers, at a temperature in excess of 430° F. evolves less than 0.1 milligrams of benzene per square inch, preferably less than 0.04 milligrams. Said paperboard and food containers are produced from a sized paperboard blank wherein a base coat and top coat comprise a mixture of an inorganic pigment and aliphatic copolymers. A base coat comprising an aliphatic latex and a pigment is applied directly to the paperboard, and a top coat comprising the same or different aliphatic polymer latex and a pigment is applied directly to the base coat to form the coated containers. Microwave susceptor layers are coated on the top coat. These containers are used to microwave and brown food at temperatures in excess of 430° F. without evolving more than 0.1 milligrams of benzene per square inch of the container surface. The coated containers are also characterized by improved grease, oil, and cut resistance, improved varnish gloss, enhanced smoothness, and improved printing quality.

47 Claims, 16 Drawing Sheets

Bowl with discontinuous
Microwave Susceptor Layer
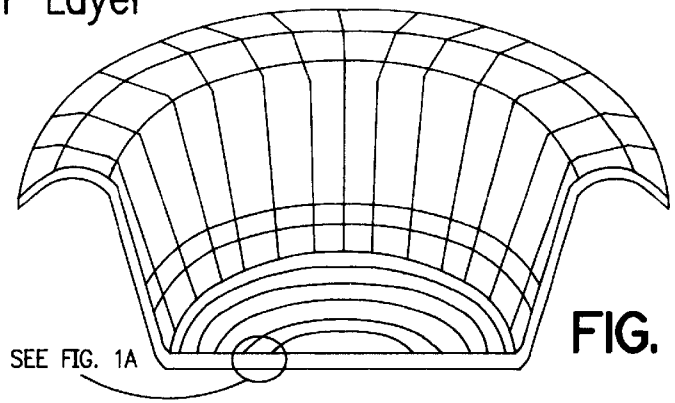
FIG. IB
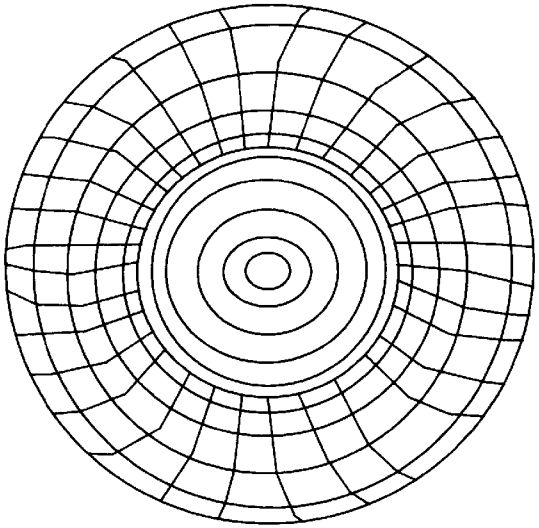
FIG. IC
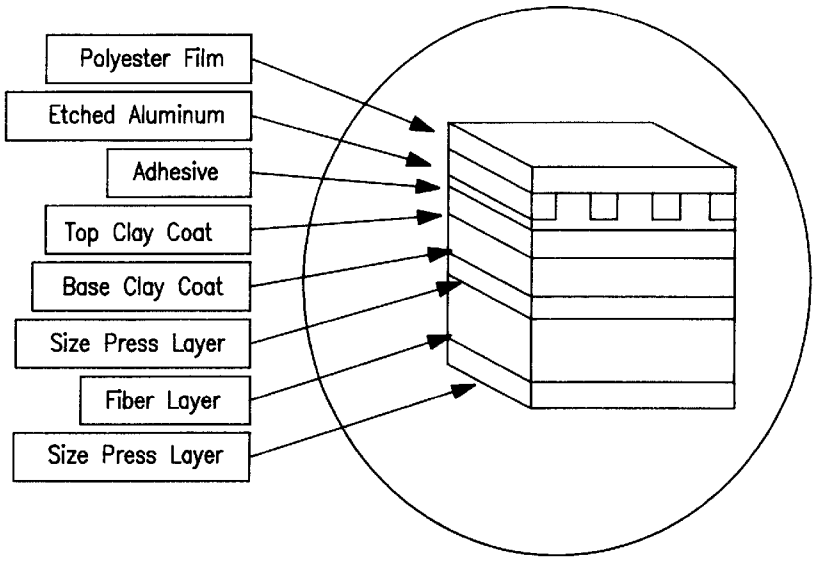
FIG. IA Bowl with continuous
Microwave Susceptor Layer Canister Compartmented Plate French Fries Sleeve Hamburger Clamshell Cup Cup Food Bucket Manufacture of basestock Manufacture of press formed articles

COATED PAPERBOARD AND PAPERBOARD CONTAINERS HAVING A MICROWAVE INTERACTIVE LAYER WHICH EMITS NONE OR VERY LOW AMOUNTS OF BENZENE IN MICROWAVE APPLICATIONS

BACKGROUND OF THE INVENTION

1. Field of the Invention

This invention relates to coated paperboards which, when converted to containers, can be used in microwave applications without emitting unacceptable amounts of benzene. Particularly, this invention relates to containers including a microwave interactive layer wherein at a microwave cooking temperature of about 430° F. or more, less than 0.1 milligrams of benzene are evolved per square inch of the container surface.

2. Background

Disposable paper containers, such as plates, trays, bowls, airline meal containers and cafeteria containers, are commonly produced by pressing flat paperboard blanks into the desired shape between appropriately shaped and heated forming dies. Various protective coatings are typically applied to the blanks before forming to make the resulting paperboard containers moisture-resistant, grease-resistant, more readily printable, etc. Often, printing is also applied to the top surface for decoration. Large numbers of paper products are produced by this method each year. These products come in many different shapes and sizes, including round, rectangular, and polygonal.

When a container is made by pressing a flat paperboard blank, the blank must contain enough moisture to make the cellulosic fibers in the blank sufficiently plastic to permit it to be formed into the desired three-dimensional container shape. During the pressing operation, most of this moisture escapes from the uncoated bottom surface of the blank as water vapor. Suitable methods of producing paperboard containers from moistened paperboard blanks are generally described in U.S. Pat. Nos. 4,721,499 and 4,721,500, among others.

Many people prefer disposable containers which, when handled, produce a sense of bulkiness and grippability at least suggestive of the more substantial non-disposable containers which they replace. While a sense of bulkiness may be provided to some extent in styrofoam and thick pulp-molded containers, such containers suffer a number of drawbacks and cannot include a microwave interactive layer. For example, unlike pressed paperboard containers, styrofoam containers are often brittle and they are environmentally unfriendly because they are not biodegradable and melt under microwaved conditions. Also, styrofoam containers are not cut-resistant and it is difficult to apply printing to the surface of styrofoam containers. Additionally, because of their bulkiness, styrofoam containers take up large amounts of shelf space and are costly to ship. Pulp-molded containers similarly are not cut-resistant and have poor printability characteristics. Additionally, pulp-molded containers typically have weak bottoms. Pressed paperboard containers, however, are cut-resistant, readily printable, strong in all areas, and are far less bully than styrofoam or pulp-molded containers and can include a microwave interactive layer.

The prior art paperboard containers have difficulty in meeting the new low benzene evolution standards set by the food processors and therefore cannot safely be used in microwave applications or include a microwave interactive layer since their coatings emit an unacceptable amount of benzene. Benzene is a well known carcinogen and its contact with food should be minimal.

SUMMARY OF THE INVENTION

The object of the present invention is to provide paperboards and paperboard containers which emit a minimal amount of benzene under microwave food preparation conditions. This is particularly critical when the container includes a microwave interactive layer. Usually benzene emission is increased when microwave susceptor layers are coated on the paperboard and/or the paperboard container. Metalized polyesters are suitably formed as a microwave susceptor layer on the paperboard surface as shown in FIG. 1. Aluminum and nickel are suitable metals. The microwaveable, food contact compatible, disposable, rigid and strong paperboards and paperboard containers of this invention at temperatures in excess of 430° F. evolve less than 0.1 milligrams of benzene per square inch, preferably less than 0.04 milligrams per square inch. This feature also holds true for the paperboard containers of this invention which include a microwave susceptor layer. These paperboard food containers comprise:

(a) a sized paperboard blank having a basis weight suitable for a selected type of food container;

(b) a base coat coating applied to one or both surfaces of the paperboard blank, the base coat coating comprising a mixture of an inorganic pigment and a polymer latex comprising aliphatic copolymers having the following monomers:

(i)

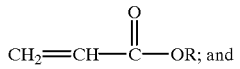

(ii)

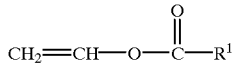

wherein R and $R^1$ may be the same or different aliphatic hydrocarbons having one to six carbon atoms and the ratio of (i) to (ii) is in the range of 1:100 to 100:1;

(c) a top coat coating layer applied to the base coat coating layer, the top coat coating layer comprising an inorganic pigment and an aliphatic polymer latex comprising aliphatic copolymers having the following monomers:

(i)

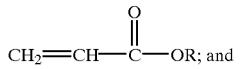

(ii)

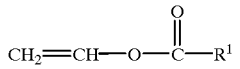

wherein R and $R^1$ may be the same or different aliphatic hydrocarbons having 1 to 6 carbon atoms and the ratio of (i) to (ii) is in the range of 1:100 to 100:1.

In a preferred mode, both R and $R^1$ are methyl groups. The paperboard blank has suitably a weight in the range of about 100 to 400 lbs. per 3000 square foot ream and a caliper in the range of about 0.008 to 0.055 inches. In a suitable variant of this invention, sufficient moisture is introduced into the blank to produce a moisture content of about 4 to 12% by weight. These microwaveable containers are suitably prepared by sizing a selected paperboard suitable for use as a food container and applying a base coating to one or both surfaces of the paperboard blank The base coat coating comprising a mixture of an inorganic pigment and a polymer latex comprising aliphatic copolymers having the following monomers:

(i)

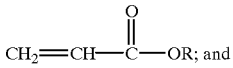

(ii)

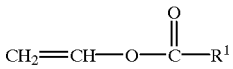

wherein R and $R^1$ may be the same or different aliphatic hydrocarbons having one to six carbon atoms and the ratio of (i) to (ii) is in the range of 1:100 to 100:1, preferably the range of (i) to (ii) is 1:3 to 3:1;

A top coat coating layer applied to the base coat coating layer, the top coat coating layer comprising an inorganic pigment and an aliphatic polymer latex comprising aliphatic copolymers having the following monomers:

(i)

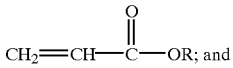

(ii)

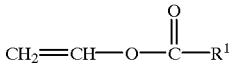

wherein R and $R^1$ may be the same or different aliphatic hydrocarbons having 1 to 6 carbon atoms and the ratio of (i) to (ii) is in the range of 1:100 to 100:1, preferably the range of (i) to (ii) is 1:3 to 3:1.

In a preferred embodiment, these paperboard containers include a microwave susceptible layer. This microwave susceptor layer is preferred for microwave cooking applications to give a brown appearance to cooked meat. Without the susceptor layer the food would also be cooked, but it would not have the pleasing brown color for meats preferred by consumers. At these high temperatures, in excess of 430° F., it is essential that evolution of benzene be kept below 0.1 milligrams per square inch of the container surface, preferably below 0.04 milligrams per square inch. According to our invention, we can tailor make the paperboard to control the evolution of benzene so that the total benzene evolution is below 0.03, 0.02, or 0.01 milligrams per square inch of the container surface.

The features of the invention which are believed to be novel are set forth with particularity in the appended claims. The invention, together with further objects, features and advantages thereof, may be best understood by reference to the following detailed description taken in conjunction with the accompanying drawings.

BRIEF DESCRIPTION OF THE DRAWINGS

FIGS. 1A, 1B and 1C are drawings of a bowl of this invention with a discontinuous microwave susceptor layer.

DETAILED DESCRIPTION

Figure 2B:
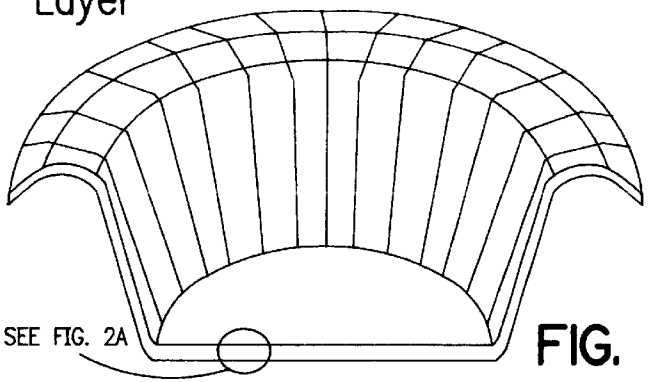
FIGS. 2A, 2B and 2C are drawings of a bowl of this invention with a continuous microwave susceptor layer.

The paperboards and containers of this invention evolve less than 0.1 milligrams of benzene per square inch at a temperature in excess of 430° F. Usually they evolve less than 0.04 milligrams of benzene per square inch at a temperature of at least 430° F. As shown in FIGS. 12 through 16, the containers of this invention comprise:

(a) a sized paperboard blank having a basis weight suitable for a selected type of food container;

(b) a base coat coating applied to one or both surfaces of the paperboard blank, the base coat coating comprising a mixture of an inorganic pigment and a polymer latex comprising aliphatic copolymers having the following monomers:

(i)

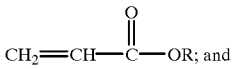

(ii)

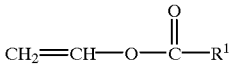

wherein R and $R^1$ may be the same or different aliphatic hydrocarbons having one to six carbon atoms and the ratio of (i) to (ii) is in the range of 1:100 to 100:1, preferably the range of (i) to (ii) is 1:3 to 3:1;

(c) a top coat coating layer applied to the base coat coating layer, the top coat coating layer comprising an inorganic pigment and an aliphatic polymer latex comprising aliphatic copolymers having the following monomers:

(i)

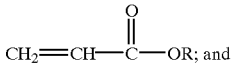

(ii)

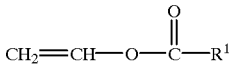

wherein R and $R^1$ may be the same or different aliphatic hydrocarbons having 1 to 6 carbon atoms and the ratio of (i) to (ii) is in the range of 1:100 to 100:1, preferably 1:3 to 3:1.

In a preferred mode, both R and $R^1$ are methyl groups. The paperboard blank has suitably a weight in the range of about 100 to 400 lbs. per 3000 square foot ream and a caliper in the range of about 0.008 to 0.055 inches. In a suitable variant of this invention, sufficient moisture is introduced into the blank to produce a moisture content of about 4 to 12% by weight.

These microwaveable containers are suitably prepared by sizing a selected paperboard suitable for use as a food container by applying a base coating to one or both surfaces of the paperboard blank The base coat coating comprising a mixture of an inorganic pigment and a polymer latex comprising aliphatic copolymers having the following monomers:

(i)

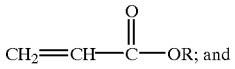

(ii)

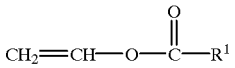

wherein R and $R^1$ may be the same or different aliphatic hydrocarbons having one to six carbon atoms and the ratio of (i) to (ii) is in the range of 1:100 to 100:1;

A top coat coating layer applied to the base coat coating layer, the top coat coating layer comprising an inorganic pigment and an aliphatic polymer latex comprising aliphatic copolymers having the following monomers:

(i)

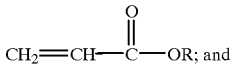

(ii)

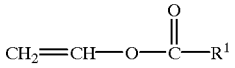

wherein R and $R^1$ may be the same or different aliphatic hydrocarbons having 1 to 6 carbon atoms and the ratio of (i) to (ii) is in the range of 1:100 to 100:1.

In a preferred embodiment, these paperboard containers include a microwave susceptible layer. This microwave susceptor layer is preferred for microwave cooking applications to give a brown appearance to cooked meat Without the susceptor layer the food would also be cooked, but it would not have the pleasing brown color for meats preferred by consumers. At the microwave cooking temperatures, in excess of 430° F., it is essential that evolution of benzene be kept below 0.1 milligrams per square inch of the container surface, preferably below 0.04 milligrams per square inch of the container surface. In our process we can control the evolution of benzene to values below 0.03, 0.02, and 0.01 milligrams per square inch of the container. Usually benzene emission is increased when microwave susceptor layers are coated on the paperboard and/or the paperboard container. Metalized polyesters are suitably formed as a microwave susceptor layer on the paperboard surface as shown in FIG. 1. Aluminum and nickel are suitable metals.

In our process, the usual conventional papermaking fibers are suitable. We utilize softwood, hardwood, chemical pulp obtained from softwood and/or hardwood chips liberated into fiber by sulfate, sulfite, sulfide or other chemical pulping processes. Mechanical pulp was obtained by mechanical treatment of softwood and/or hardwood. Recycled fiber and other refined fiber may suitably be utilized in our paperboard manufacturing process.

Papermaking fibers used to form the paperboard used to form the microwaveable containers of this invention include cellulosic fibers commonly referred to as wood pulp fibers, liberated in the pulping process from softwood (gymnosperms or coniferous trees) and hardwoods (angiosperms or deciduous trees). The particular tree and pulping process used to liberate the tracheid are not critical to the success of the present invention. Cellulosic fibers from diverse material origins may be used to form the web of the present invention including cottonwood and non-woody fibers liberated from sabai grass, rice straw, banana leaves, paper mulberry (i.e., bast fiber), abaca leaves, pineapple leaves, esparto grass leaves, and fibers from the genus Hesperaloe in the family Agavaceae. Also recycled fibers which may contain any of the above fiber sources in different percentages can be used in the present invention.

Papermaking fibers can be liberated from their source material by any one of the number of chemical pulping processes familiar to one experienced in the art including sulfate, sulfite, polysulfite, soda pulping, etc. The pulp can be bleached if desired by chemical means including the use of chlorine, chlorine dioxide, oxygen, hydrogen peroxide, etc. Furthermore, papermaking fibers can be liberated from source material by any one of a number of mechanical/chemical pulping processes familiar to anyone experienced in the art including mechanical pulping, thermomechanical pulping, and chemi-thermomechanical pulping. These mechanical pulps can be bleached, if one wishes, by a number of familiar bleaching schemes including alkaline peroxide and ozone bleaching.

Generally in our process the range of hardwood to softwood varies from 0–100% to 100 to 0%. The preferred range for hardwood to softwood is about 20 to 80 to about 80 to 20; the most preferred range of hardwood comprises about 40 to about 80 percent of the furnish and the softwood comprises about 60 to about 20 percent of the furnish.

FIGS. 12, 13, 14, 15, and 16 provide a schematic layout of a suitable process for the manufacture of the useful paperboard and for the manufacture of the articles of manufacture of this invention useful in microwaving food and using the paperboard as raw material. These figures also show the microwave susceptor layer.

Figure 2C:
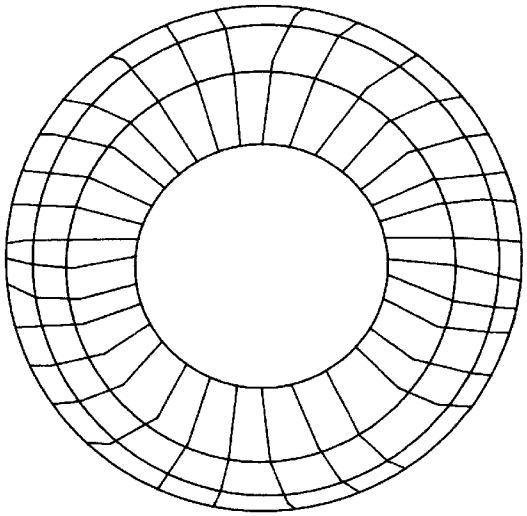
Figure 2A:
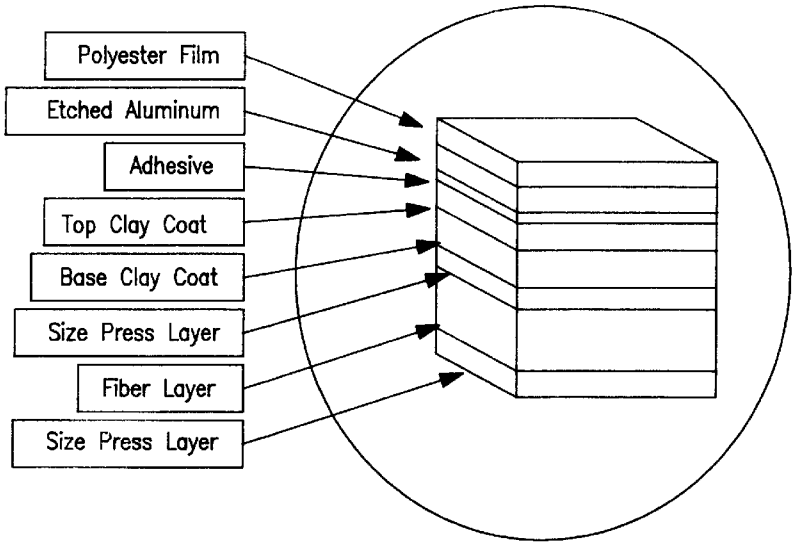
Figure 4A:
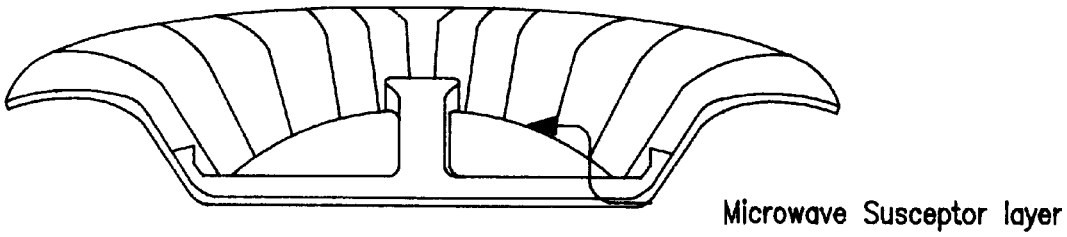
FIGS. 4A and 4B are drawings of a compartmented plate with a microwave susceptor layer.
Figure 4B:
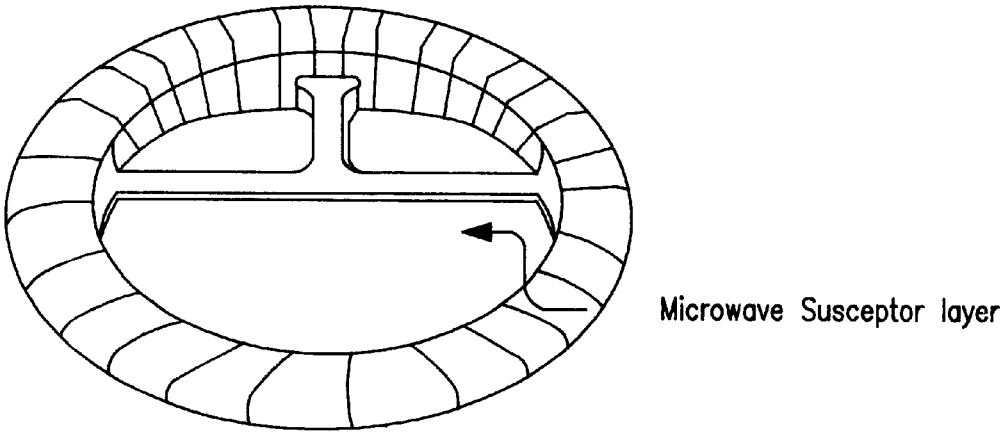
Figure 12:
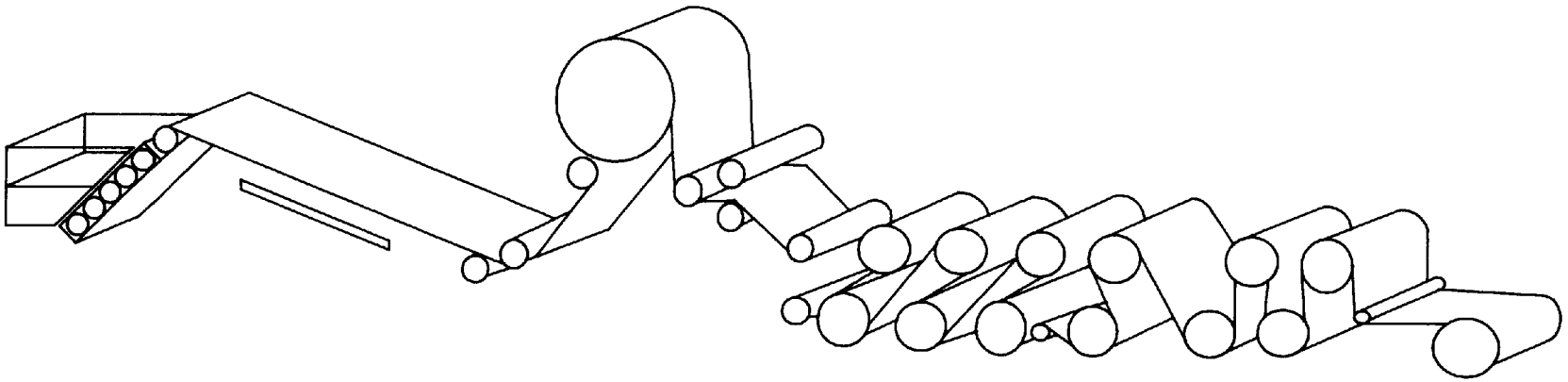
FIG. 12 is a drawing of a manufacturing operation of the paperboard basestock
Figure 13:
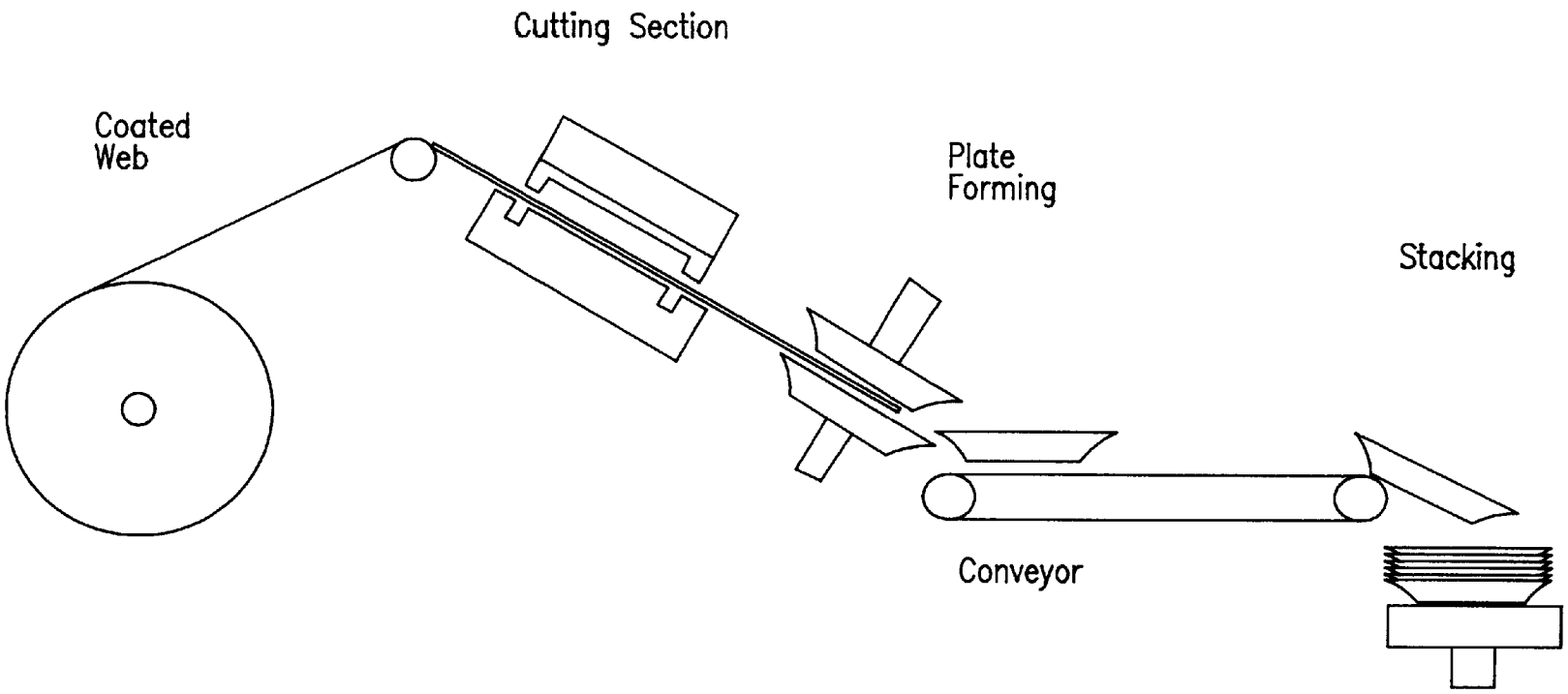
FIG. 13 is a drawing of a manufacturing process for the manufacture of the containers of this invention starting with the coated paperboard web.
Figure 14:
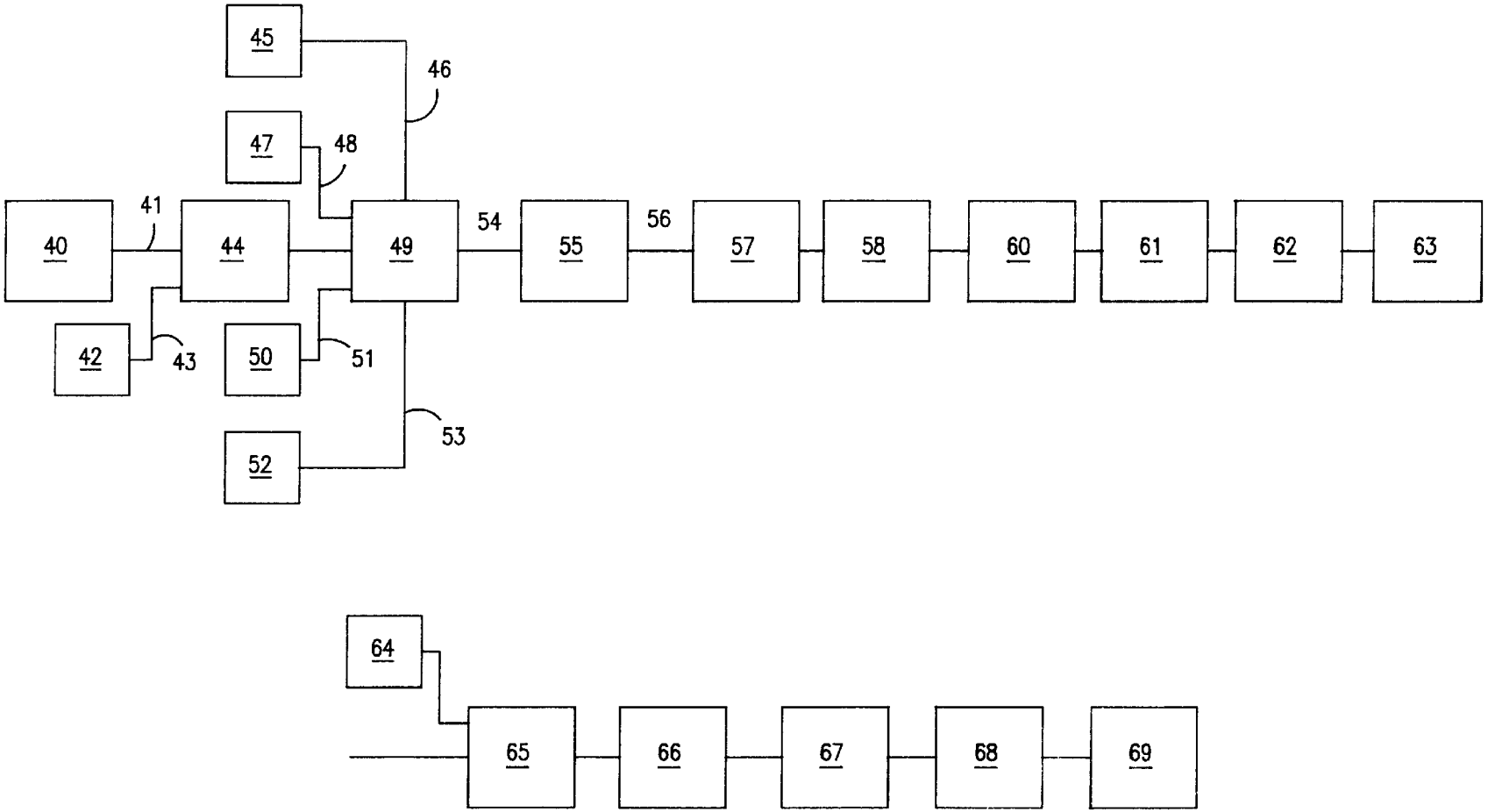
FIG. 14 is a flow diagram depicting the process for the manufacture of the paperboard of this invention.
Figure 16:
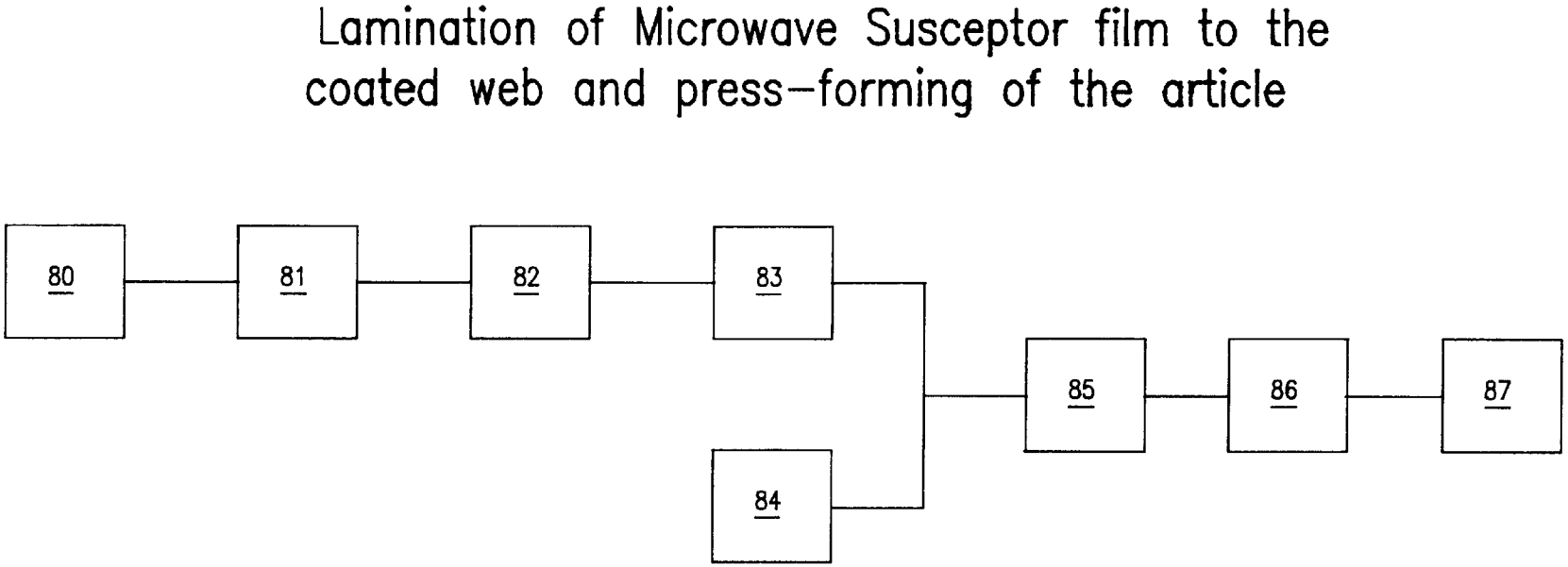

In FIG. 14 it is shown that feedstock is pumped into the mix box 40. Alum and other internal sizing agents are added to the feedstock along line 41 prior to it being pumped into the machine chest (44). Optionally a wet strength agent such a Parez or Kymene is added to the feedstock through line (43) at the machine chest (44). Suitable wet strength agents are nitrogen containing polyamides. For food service products, if the food comes in contact with the wet strength agent, it has to be approved by the FDA Representative polyamides are listed in European Patent Application 91850148.7 relating to polyamide epichlorohydrin (PAE) wet strength resins and that patent application is incorporated herein by reference. Parez 631NC which is a glyoxylated polyacrylamide is a suitable wet strength agent. In the stuff box (49) starch is charged through line (46), and optionally blue dye is charged through line (48); for pH control, a base such as caustic is charged through line (51). The cationic starch is added through line (54) and prior to the cleaners (55). The embryonic paperboard web is formed on the fourdrinier wire (58). The water is removed through a water removal apparatus (60). Initially the water is removed from the bottom side of the sheet through the fourdrinier table and from the top side of the web through the BelBond vacuum system. The web is heated with steam through steam showers (61), and the paperboard web is pressed in the press section (62) and dried in the dryer sections (63). Starch is supplied through line 64 to the size press (65). The web is passed through calender stacks (66) to smooth the web. Coating section (67) represents one to six coaters. The binder and optionally pigment is coated on both sides of the paperboard. Usually about three to six coatings are provided. For paper cup and related applications, usually the paperboard is not coated. The coated or uncoated paperboard is calendered in the gloss calender (68) and rolled on the reel (69). The paperboard is optionally placed in a printing press (70) for plate and bowl applications. Suitably a rotogravure press, flexopress or lithopress is utilized. Advantageously two to eight colors are printed on the reel. The printed reel is placed in a coater (71) where optionally two plate coatings are applied. Optionally, the reeled web is suitably moistened in a wetting applicator (72) (Dahlgren Press). The moistened web is wound onto a reel (73). A moistened web is utilized in the manufacture of articles which require significant deformation of the board. Representative articles requiring significant deformation of the board are bowls shown in FIGS. 1 and 2 and plates shown in FIG. 4. In FIG. 12 the paperboard manufacturing process is illustrated. In FIG. 16 at (80) the polyterephthalate film is applied to the paperboard where at (81) the surface is metalized, usually aluminized, at (82) the coated metalized surface is etched, at (83) adhesive is applied, at (84) we have the coated web which is shape cut at (85) and formed into containers such as bowls, and at (87) the bowls are stacked. Representative bowls made by the process set forth in FIG. 16 are shown in FIGS. 1 and 2.

Moisture may be introduced into the paperboard blank in the form of water or preferably as a moistening/lubricating solution. When blank stock in roll form is used, as in commercial scale operations, the blank stock is unrolled, coated as described above, wetted, rerolled, and allowed to stand for up to 24 hours or more before die-cutting is undertaken. Water is the preferred moistening solution.

Figure 3A:
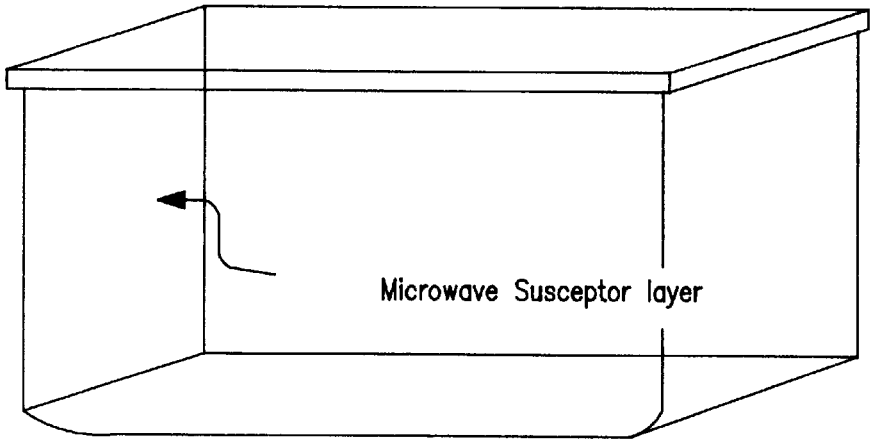
FIGS. 3A and 3B are drawings of a canister of this invention with a microwave susceptor layer.
Figure 3B:
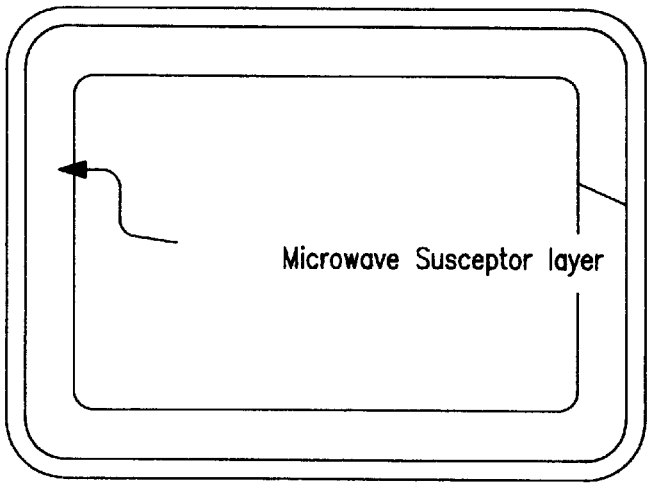
Figure 5:
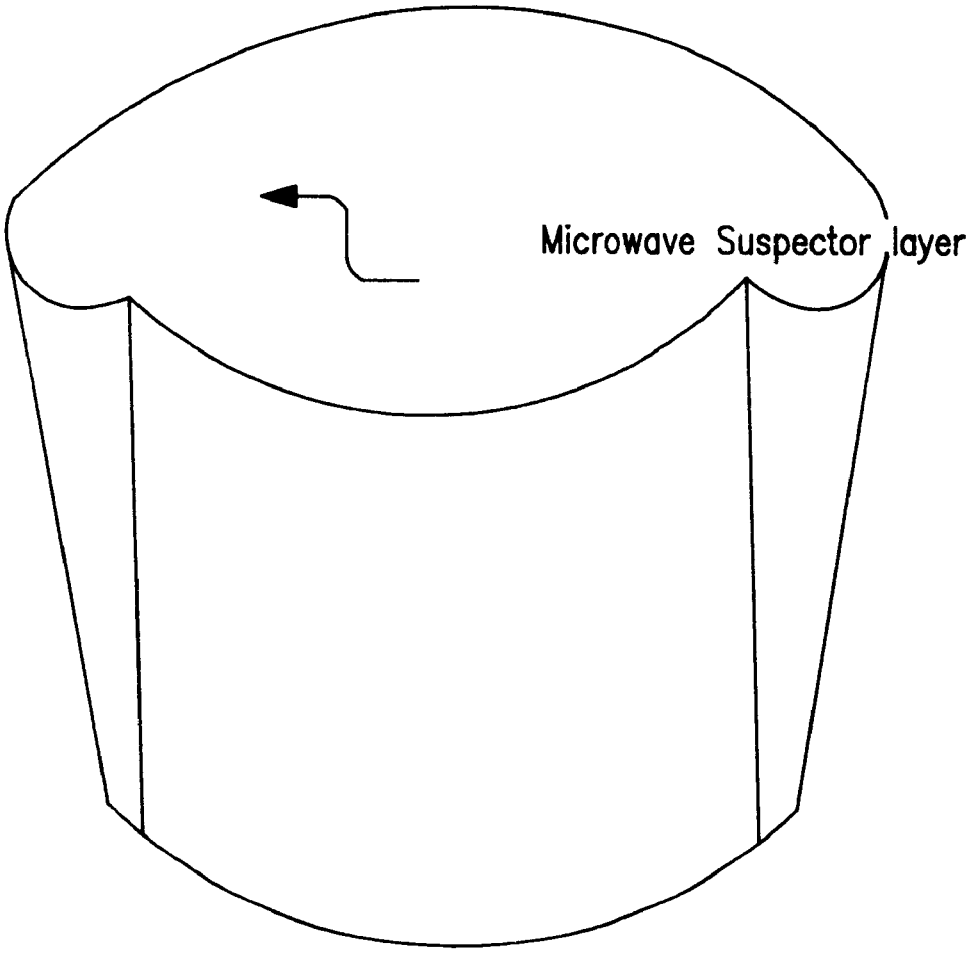
FIG. 5 is a drawing of a French fry sleeve of this invention with a microwave susceptor layer.
Figure 6A:
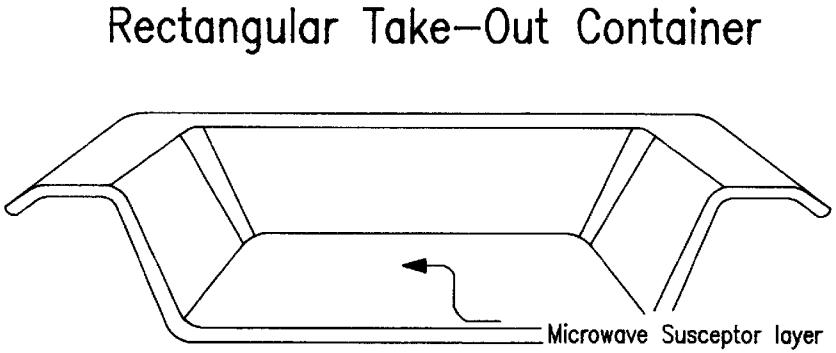
FIGS. 6A and 6B are drawings of a rectangular take-out container of this invention with a microwave susceptor layer.
Figure 6B:
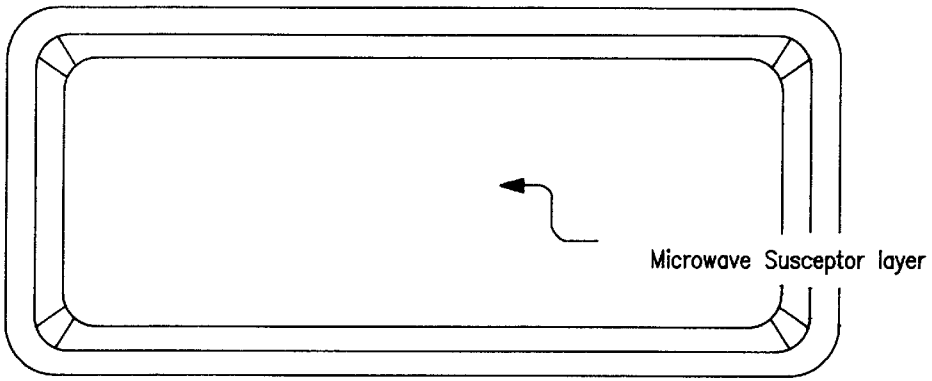
Figure 7A:
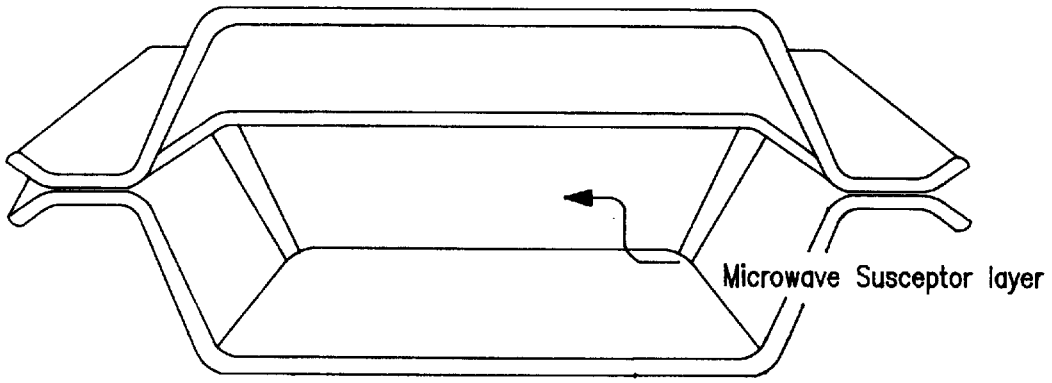
FIGS. 7A and 7B are drawings of a hamburger clamshell of this invention with a microwave susceptor layer.
Figure 7B:
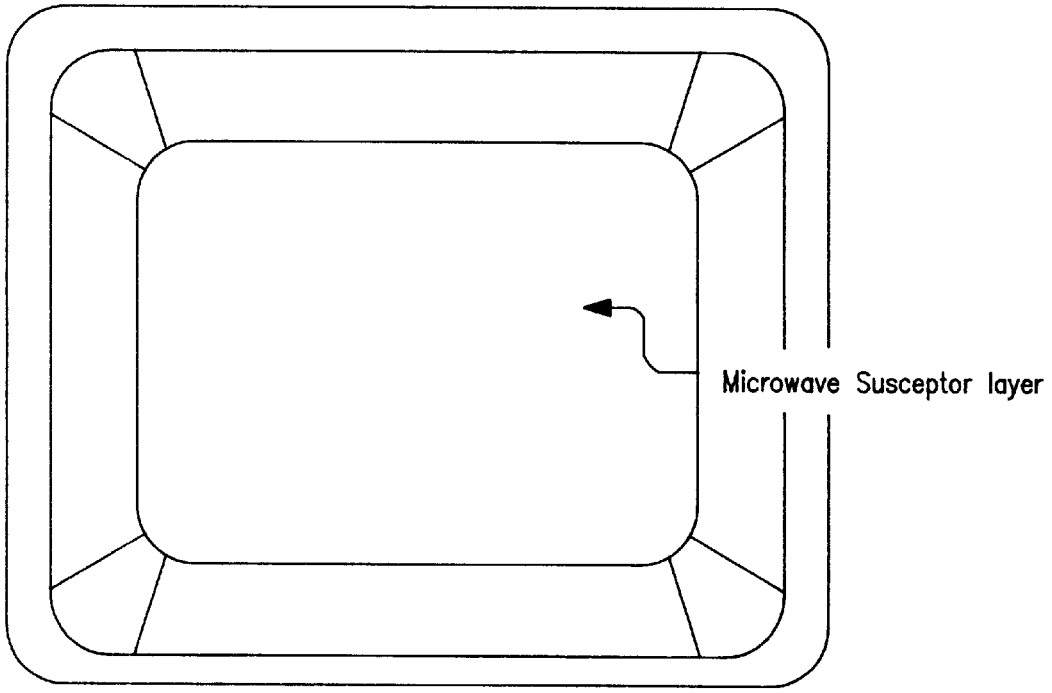
Figure 8A:
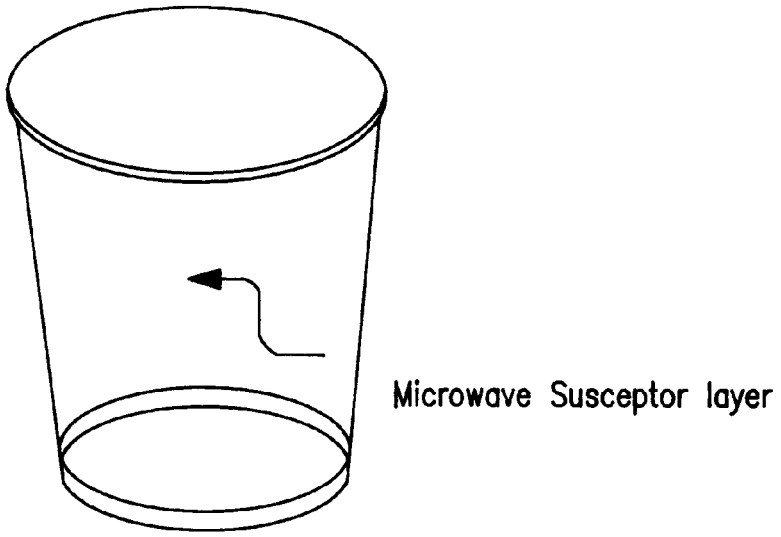
FIGS. 8A and 8B are drawings of a cup of this invention with a microwave susceptor layer.
Figure 8B:
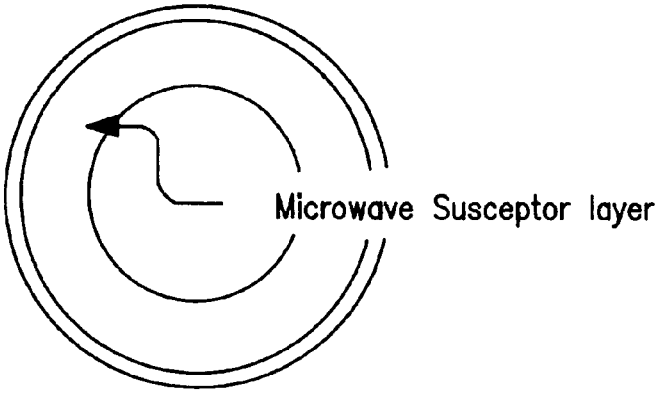
Figure 9A:
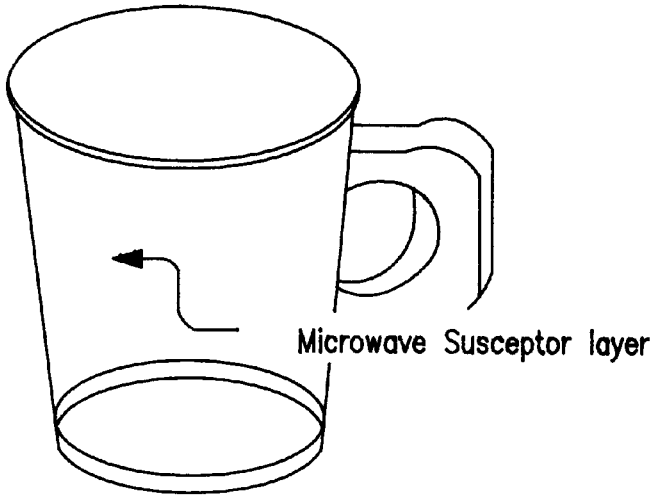
FIGS. 9A and 9B are drawings of a cup with handles of this invention with a microwave susceptor layer.
Figure 9B:
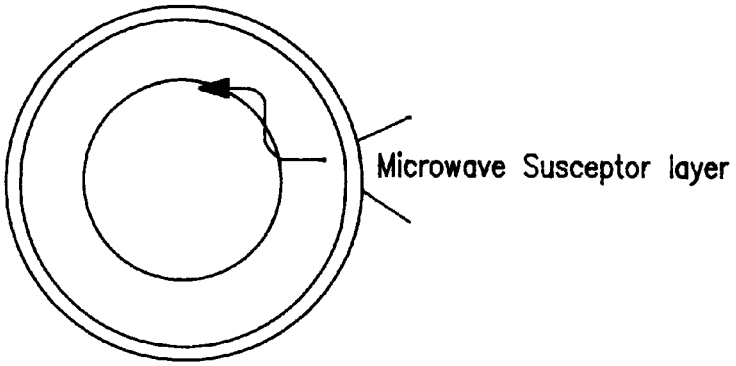
Figure 10A:
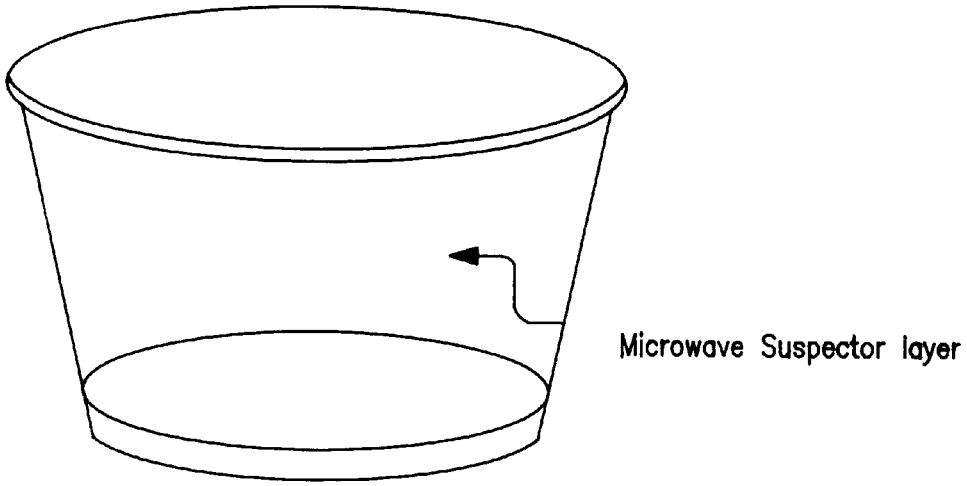
FIGS. 10A and 10B are drawings of a food bucket of this invention with a microwave susceptor layer.
Figure 10B:
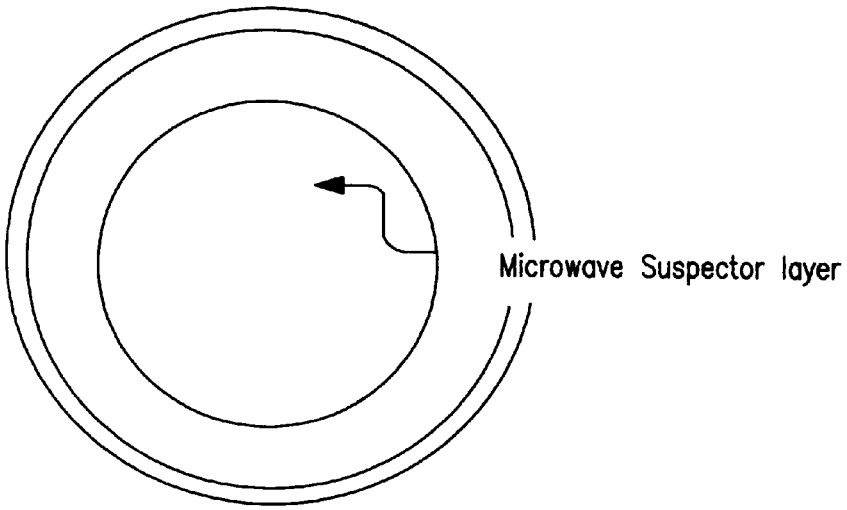
Figures 11A, 11B:
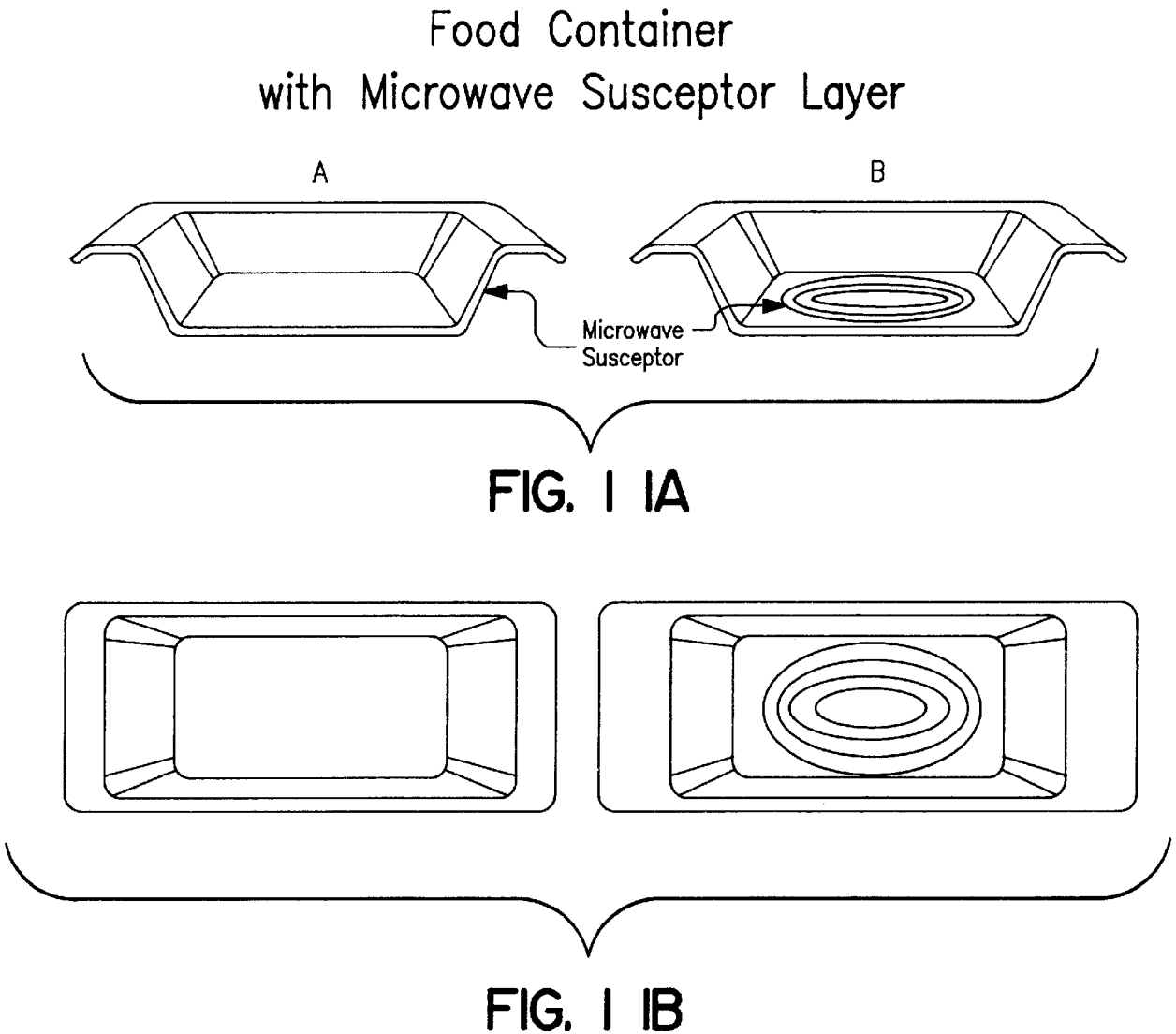
FIGS. 11A and 11B are drawings of a food container of this invention with a microwave susceptor layer.
Figure 15:
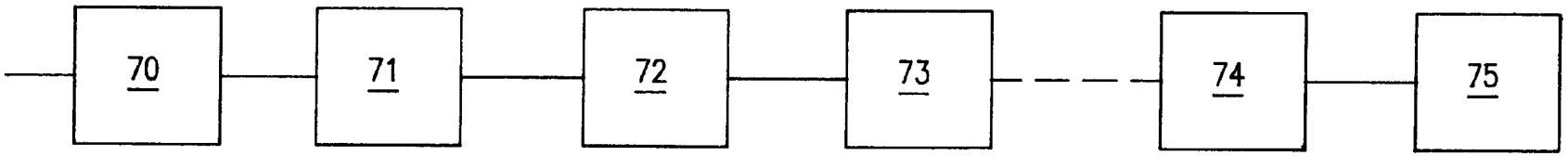
FIGS. 15 and 16 are the flow diagrams depicting the conversion of the paperboard to the containers of this invention including the microwave susceptor layer.

In FIG. 15 the paperboard from reel (73) is fed into the die press (74) where the paperboard is scored and cut. This blank is fed into the die (75) which is capable of forming the desired articles of manufacture such as bowls, FIGS. 1 and 2; plates, FIG. 4; canisters, FIG. 3; French fry sleeves, FIG. 5; hamburger clam shells, FIG. 7; rectangular take-out containers, FIG. 6; food buckets, FIG. 10; cups, FIG. 8; food containers, FIG. 11; and other consumer products. Optionally these containers have a microwave susceptible layer to enable the browning of meat products.

The paperboard material is coated with a coating polymer which does not produce benzene when the container made from the paperboard is used in microwaving food prior to formation of the paperboard shells used in forming the containers in accordance with the present invention. Polymers suitable for this purpose are aliphatic copolymers having the following monomers:

(i)

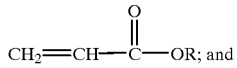

(ii)

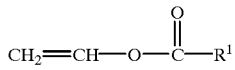

wherein R and $R^1$ may be the same or different aliphatic hydrocarbons having one to six carbon atoms and the ratio of (i) to (ii) is in the range of 1:100 to 100:1, preferably in the range of about 1:3 to 3:1.

Suitably a top coat coating layer is applied to the base coat coating layer, the top coat coating layer comprising an inorganic pigment and an aliphatic polymer latex comprising aliphatic copolymers having the following monomers:

(i)

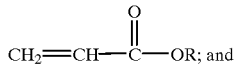

(ii)

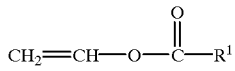

wherein R and $R^1$ may be the same or different aliphatic hydrocarbons having 1 to 6 carbon atoms and the ratio of (i) to (ii) is in the range of 1:100 to 100:1, preferably in the range of 1:3 to 3:1.

The use of the above set forth coatings is expected to achieve a benzene evolution of less than 0.1 milligram per square inch of container surface at temperatures in excess of 430° F. Many manufacturers of microwaveable food products request that the benzene evolved at 430° F. be less than 0.04 milligrams per square inch of the container surface, sometimes less than 0.03 milligrams per square inch of container surface. In our process we can achieve a benzene evolution of less than 0.01 milligrams per square inch of the container surface.

Conveniently for microwave applications as shown in FIGS. 1 through 12, a microwave susceptor layer is laminated on top of the paperboard substrate on which a pigment has been coated. The microwave susceptor layer comprises alumina and polyester compositions. Polyethylene terephthalate is the preferred polyester composition, THERMX™ copolyester PCIA 6761 resin is also useful. The films in general are metalized polyesters wherein the metal is aluminum, nickel, etc.

The cooking of food and heating of substances with microwave radiation has become increasingly popular and important in recent years because of its speed, economy, and low power consumption. With food products, however, microwave heating has drawbacks. One of the major drawbacks is the inability to brown or sear the food product to make it similar in taste and appearance to conventionally cooked food.

One method involves the use of a metalized coating on paperboard. In this method, first, metal particles are vacuum deposited onto a film, preferably a polyester film. The film is then laminated onto the paper. The thus metalized paper, typically, must then be positioned onto a particular part of the food package requiring a windowing operation. The windowing operation requires that the metalized paper be slit before entering the process.

A microwave interactive coating which is capable of being printed on a substrate is also suitable. This coating overcomes the problems inherent in vacuum deposited metal coatings because the coatings can be printed exactly where they are required. Furthermore, coating patterns, coating formulations, and coating thicknesses can all be varied using conventional printing processes. A printing process also allows the use of materials besides metals as microwave reactive materials, as well as providing the possibility for a wide range of heating temperatures and a wide variety of applications.

The microwave interactive printable coating composition comprises a microwave reactive material selected from a conductor or semiconductor, a dielectric, or a ferromagnetic and a binder.

The microwave interactive printable coating is coated onto a film which is further laminated to a microwave transparent substrate.

In another embodiment, a method of manufacturing a microwave interactive coated substrate is provided. This substrate comprises coating a substrate using a conventional printing process with a microwave interactive printable coating composition comprising a microwave reactive material selected from a conductor or semiconductor, a dielectric, or a ferromagnetic, and a binder.

Microwave reactive materials (MRM) are capable of converting microwave energy to heat. This is accomplished using either the conductive or semiconductive properties., dielectric properties, or ferromagnetic properties of the microwave reactive materials. The materials having these properties will hereafter be referred to as conductors, semiconductors, dielectrics or ferromagnetics.

The microwave reactive materials included within the scope of this invention include any material which has suitable conductive or semiconductive, dielectric or ferromagnetic properties so that the material is capable of converting microwave radiation to heat energy. The materials can have any one of the above properties or can have a combination of the above properties. Furthermore, the properties of the substrate on which the material is coated, such as the orientation, heatset temperature, and melting point, as well as the adhesion between the coating and the substrate will affect the reactiveness of the materials to microwave energy.

The type and amount of microwave reactive materials used in the coating composition generally determines the degree of interaction with the microwaves and hence the amount of heating. In a preferred embodiment where the material used is conductive, the amount of heat generated is a function of the product of the conductivity of the material and the thickness of the material. In one aspect of this embodiment, when the microwave reactive material is carbon, the microwave reactive material combined with binder will preferably have a resistivity ranging from 50 ohms per square to 10,1000 ohms per square. Our containers containing a microwave susceptible layer cannot evolve more than 0.1 milligram of benzene per square inch of container surface. Preferably no more than 0.04 milligrams of benzene are evolved and most preferably less than 0.03 milligrams of benzene are evolved. This low benzene evolution has to be maintained at cooking temperatures of 430° F. or more.

Generally any metal, alloy, oxide, or any ferrite material which has microwave reactive properties as described above can be used as a microwave reactive material. Microwave reactive materials include suitable compositions comprising aluminum, iron, nickel, copper, silver, carbon, stainless steel, nichrome, magnetite, zinc, tin, iron, tungsten, titanium, and the like. The materials can be used in a powder form, flake form, or any other finely divided form which can be suitably used in printing processes. The microwave reactive materials can be used individually or can be used in combination with other microwave reactive materials.

In the preferred embodiment, the microwave reactive material will be suitable for food packaging. Alternatively, the microwave reactive material will be separated from the food by a film or other protective means.

It is preferred that the microwaver reactive materials demonstrate rapid heating to a desired temperature, with subsequent leveling off of the temperature, without arcing during the material's exposure to microwave radiation. The temperature at which the microwave reactive material levels off is hereinafter referred to as the operating temperature. Generally the microwave reactive material will operate at a temperature ranging from about 430° F. to 480° F.

The microwave reactive material is combined with a binder to form a coating composition. The binder used in this invention can comprise any aqueous or hydrocarbon dispersed or dissolved material that can be used in a printing process provided it does not evolve more than 0.1 milligrams of benzene per square inch, preferably less than 0.04 milligrams, and most preferably less than 0.03 milligrams of benzene per square inch. Suitable binders are aliphatic copolymers having the following monomers:

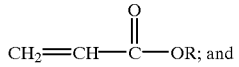

(i)

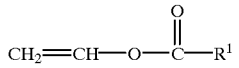

(ii)

wherein R and $R^1$ may be the same or different aliphatic hydrocarbons having one to six carbon atoms and the ratio of (i) to (ii) is in the range of 1:100 to 100:1, preferably 1:3 to 3:1.

The binder must have good thermal resistance and suffer little or no degradation at the temperatures generated by the microwave reactive material. It must also have an adhesive ability which will allow it to adhere to the substrate.

In one preferred embodiment of this invention, an important aspect is that the microwave reactive material coated substrate must shrink during the heating process at a controlled rate so that the temperature of the coating rises rapidly and then remains at a constant level. In this embodiment it is important that the binders chosen be adhesive enough to bind the microwave reactive material to the substrate during the treatment with microwave energy.

The binder and the microwave reactive material are generally combined in a suitable ratio such that the microwave reactive material, in the form of a thin film, can convert the microwave radiation to heat to raise the temperature of a food item placed thereon, yet still have sufficient binder to be printable and to adhere to the film. There should also be sufficient binder present to prevent arcing of the microwave reactive material.

Generally the ratio of the microwave reactive material to binder, on a solids basis, will depend upon the microwave reactive material and binder chosen. In a preferred embodiment where the microwave reactive material is nickel, the microwave reactive material to binder ratio, on a weight basis, should be about 2:1 or higher.

Other materials can be included in the coating composition such as surfactants, dispersion aids, and other conventional additives for printing compositions. The coating can be applied using conventional printing processes such as rotogravure, flexography, and lithography. After the coating composition has been applied, it can be dried using conventional printing ovens normally provided in a printing process.

Generally, any amount of coating can be used. The amount of heat generated will vary according to the amount and type of coating applied to the substrate. In a suitable embodiment, when the coating material is nickel, the amount of coating Will range from about 3 to about 11 pounds per 3000 square foot ream.

The coating composition can generally be coated upon any substrate such as paper or paperboard or any suitable film material which does not melt at temperatures of about 430° F. to 500° F. and does not evolve more than 0.04 milligrams of benzene per square inch of surface at these temperatures.

A desirable feature for the microwave reactive coated substrates is that the substrate should either shrink during the heating process at a controlled rate or in some other manner the interparticle network of the coating should be disrupted so that the temperature of the coating rises rapidly and then remains at a constant level.

In a preferred embodiment of this invention, the coating composition is printed onto an oriented film. The film can be selected from any known films such as polyesters, nylons, polycarbonates, and the like. The film used generally should be shrinkable at the operating temperatures of the microwave reactive material but any film material which shrinks can be used. The film must also have a melting point above the operating temperature of the microwave reactive material. That is, it must melt above 430° F. to 500° F. and evolve no more than 0.04 milligrams of benzene per square inch of the container surface at a temperature of at least 430° F. A particularly preferred class of films include oriented polyester films such as Mylar®.

The thus coated film is then applied to a microwave transparent substrate. The substrate, preferably, is also dimensionally stable at the operating temperature of the microwave reactive material. Typical substrates include paper and paperboard.

The film is attached to the substrate using conventional adhesives. The adhesives used must be able to withstand heating temperatures within the operating range of the microwave reactive material that is a temperature of about 430° F. to 480° F. The adhesive must also be able to control the rate at which the film shrinks and must not evolve benzene more than 0.03 milligrams per square inch of the paperboard container surface.

Suitable microwaveable packages comprise a dielectric substrate substantially transparent to microwave radiation having at least a portion of at least one surface thereof coated with a coating composition comprising a dielectric polymeric matrix having incorporated therein (a) particles of a microwave susceptor material; and (B) particles of a blocking agent.

In general, the dielectric substrate may be any material having sufficient thermal and dimensional stability to be useful as a packaging material at the high temperatures which may be desired for browning or rapidly heating foods in a microwave oven (e.g., at temperatures in excess of 430° F.). Useful substrates include polymeric terephthalate films as well as polymethylpentene films and films of other thermally stable polymers such as polyacrylates, polyamides, polycarbonates, polyetherimides, polyimides, and the like, provided they do not evolve more than 0.04 milligrams of benzene per square inch of the container surface at temperatures in excess of 430° F. Moreover, porous structures such as paper or non-woven materials can also be employed as substrates so long as the required thermal and dimensional stability is satisfied. For flexible packaging the substrate is preferably about 8 to 50 micrometers thick. Thicker, non-flexible materials, such as found in trays, lidding, bowls, and the like, may also be employed.

Suitably, the substrate must have sufficient dimensional stability at the elevated temperatures (430° F. to 480° F.) involved in microwave cooking to prevent distortion of the substrate which may result in non-uniform cooking from loss of intimate contact of the packaging material with the food to be cooked. Substrates normally lacking such high temperature dimensional stability can be used if they are laminated with yet another substrate layer meeting the thermal stability requirements of the original substrate and do not evolve benzene more than 0.03 milligrams per square inch of the paperboard container surface. The lamination can be accomplished either by taking advantage of the adhesive properties of the thermoplastic matrix coating on the original substrate or by using any number of conventional adhesives to aid in forming a stable laminate. For example, a polyester copolymer coated polyethylene terephthalate film can be thermally sealed to another polyester film or to paper or heavier ovenable paperboard. Alternatively, another adhesive can be applied from solution prior to lamination to increase the strength of the laminate. These supplemental adhesives can be selected from a number of commercially available candidates with required thermal stability. These include copolyesters, copolyester-polyurethanes, and cyanoacrylates.

The dielectric polymeric material forming the matrix of the coating composition may be composed of a variety of materials which, when deposited onto a suitable substrate, exhibit sufficient thermal stability to allow for dimensional integrity of the final packaging material at the elevated temperatures (430° F. to 480° F.) associated with microwave cooking of food.

The dielectrical properties at 915 megahertz and 2450 megahertz of the matrix formed by the deposition of the polymeric material upon the packaging substrate is an important variable in terms of the heat generated in unit time at 2450 Mhz Specifically, the dielectric matrix should, in general, possess a relative dielectric constant of between about 2.0 and about 10, preferably of between about 2.1 and about 5, and should generally possess a relative dielectric loss index of between about 0.001 and about 2.5, preferably of between about 0.01 to 0.6. The matrix also preferably displays adhesive characteristics to the substrate as well as to any additional substrate to which the composite may be laminated to increase dimensional stability.

The microwave susceptor materials employed include any materials which are capable of absorbing the electric or magnetic portion of the microwave field energy and converting that energy into heat. Suitable materials include metals such as powdered nickel, antimony, copper, molybdenum, bronze, iron, chromium, tin, zinc, silver, gold, and aluminum. Other conductive materials such as graphite and semi-conductive materials such as silicon carbides and magnetic material such as metal oxides (if available in particulate form) may also be utilized. Particularly preferred susceptor materials include alloys of copper, zinc, and nickel sold under the designation SF401 by Obron; as well as leafing aluminum powder.

Suitable susceptor materials employed are in particulate form. Such particles may be flakes or powders. The size of such particles will vary in accordance with a number of factors, including the particular susceptor material selected, the amount of heat to be generated, the manner in which the coating composition is to be applied, and the like.

Typically, however, when such coating compositions are to be applied in the form of inks, due to limitations of the printing processes, such powders will have diameters of no more than about 50 microns. In general, in such circumstances, particle sizes of between about 0.1 and about 25 microns are preferably employed. When the susceptor materials are employed in the form of flakes (e.g., such as in the form of leafing aluminum), such flakes are typically of those sizes of flakes routinely used in the gravure ink art for the printing of metallic coatings.

A suitable blocking agent employed comprises at least one member of the group consisting of calcium salts, zinc salts, zinc oxide, lithopone, silica, and titanium dioxide. Preferred blocking agents include calcium carbonate, calcium sulfate, zinc oxide, silica, and titanium dioxide, and calcium carbonate, with calcium carbonate being most preferred.

Suitable blocking agents are typically employed in particulate form. The particle size of such blocking agents is generally limited by the particular coating process employed, and when such coating is applied in the form of an ink, such particle size is typically less than about 50 microns, with particle sizes of between about 0.1 and about 25 microns being preferred for most blocking agents. When calcium carbonate is employed as the blocking agent, particle sizes of between about 1 and about 10 microns are more preferred, with particle sizes of between about 3 and about 7 microns being most preferred.

It is believed that the presence of such blocking agents control the amount of heat generated by the susceptor material. By controlling the ratio and amount of blocking agent and susceptor, and/or by varying the thickness of the ink applied, the amount of heat generated by a preselected dosage of microwave radiation may be consistently controlled within a preselected range. In applications contemplated by this invention, the temperature will be in excess of 430° F.

Variables which must be taken into account for determining the precise ratios of susceptor to blocking agent needed for any particular use include the physical size, shape, and surface characteristics of the susceptor and blocking agent particles contained in the coating composition, the amount of coating composition to be applied to the substrate, and the portion size as well as the food to be cooked in such application. By so altering these variables as well as the susceptor:blocking agent ratio employed, one of ordinary skill can easily regulate the compositions utilized herein to heat to high temperatures in a controlled manner in relatively short periods of time in conventional microwave ovens, e.g., to temperatures above 430° F. in 120 seconds when subjected to microwave energy generated in dosages typically produced by such ovens, e.g., at 550 watts at 2450 megahertz.

The susceptor level in the matrix will generally range from about 3 to about 80% by weight of the combined susceptor blocking agent/matrix composition. As noted above, the optimum levels of susceptor material and of blocking agent incorporated into the coating compositions will depend upon a number of factors, depending upon the ultimate end use employed. However, it has been found that, in many instances, weight ratio of 1:4 or more of blocking agent susceptor material will effectively prevent heating of the coating composition when subjected to dosages of microwave radiation generated by conventional microwave ovens. Lower ratios of blocking agent to receptor material will result in higher temperatures.

One of ordinary skill in the art can easily determine optimum ratios for any particular application using routine experimentation.

In addition to the blocking agent, polymeric material liquid carrier and susceptor material the coating composition employed in the microwaveable package may optionally contain other conventional additives such as surface modifiers such as waxes and silicones, antifoam agents leveling agents, surfactants, colorants such as dyes and pigments and the like, which additives are well known to those of ordinary skill in the art.

Suitable microwaveable packaging ink composition comprises a liquid carrier having dispersed or dissolved therein (A) a matrix-forming dielectric polymeric material substantially transparent to microwave radiation; (B) particles of a susceptor material; and (C) particles of a blocking agent.

The liquid carriers which may be employed include those organic solvents conventionally employed in the manufacture of ink as well as water and mixtures of one or more of the foregoing. Illustrative of such solvents are liquid acetates such as isopropyl acetate and the like; alcohols such as isopropanol, butanol, and the like; ketones such as methyl ethyl ketone and the like. Particularly preferred solvents include water, isopropyl acetate, and mixtures of isopropyl acetate. These solvents cannot evolve more than 0.03 milligrams of benzene per square inch of container surface at a temperature of 430° F.

The coating formulation may also include a mineral filler to increase the solids level of the polymeric binder mixture. The mineral filler should be present at a level of about 0 to 50 percent by weight and more preferably about 20 to 40 percent by weight. Suitable mineral fillers include, for example, kaolin clays, calcium carbonate, titanium dioxide, zinc oxide, chalk barite, silica, talc, bentonite, glass powder, alumina, graphite, carbon black, zinc sulfide, alumina silica, and mixtures thereof. Hydrafine clay, which is a hydrated aluminum silicate or kaolin with 0.9–2.5% titanium dioxide manufactured by J.M. Huber Corp. of Macon, Ga. is one preferred mineral filler.

By way of example, suitable surface sizing agents include starch, starch latex copolymers, animal glue, methyl cellulose, carboxymethyl cellulose, polyvinyl alcohol, and wax emulsions. Preferably, starch or a starch latex copolymer is employed as a sizing agent. By way of example, suitable commercially available sizing agents containing starch include "PENFORD® GUMS 200," "PENFORD® GUMS 220," "PENFORD® GUMS 230," "PENFORD® GUMS 240," "PENFORD® GUMS 250," "PENFORD® GUMS 260," "PENFORD® GUMS 270," "PENFORD® GUMS 280," "PENFORD® GUMS 290," "PENFORD® GUMS 295," "PENFORD® GUMS 300," "PENFORD® GUMS 330," "PENFORD® GUMS 360," "PENFORD® GUMS 380," "PENFORD® GUMS PENCOTE®," "PENFORD® GUMS PENSPRAE® 3800," "PENFORD® GUMS PENSURF," "PENGLOSS®," "APOLLO® 500," "APOLLO® 600," "APOLLO® 600-A," "APOLLO® 700," "APOLLO® 4250," "APOLLO® 4260," "APOLLO® 4280," "ASTRO® GUMS 3010," "ASTRO® GUMS 3020," "ASTROCOTE® 75," "POLARIS® GUMS LV," "ASTRO®×50," "ASTRO®×100," "ASTRO®×101," "ASTRO®×200," "ASTRO® GUM 21," "CALENDER SIZE 2283," "DOUGLAS®-COOKER 3006," "DOUGLAS®-COOKER 3007," "DOUGLAS®-COOKER 3012-T," "DOUGLAS®-COOKER 3018," "DOUGLAS®-COOKER 3019," "DOUGLAS®-COOKER 3040," "CLEARSOL® GUMS 7," "CLEARSOL® GUMS 8," "CLEARSOL® GUMS 9," "CLEARSOL® GUMS 10," "DOUGLAS®-ENZYME 3622," "DOUGLAS®-ENZYME E-3610," "DOUGLAS®-ENZYME E-3615," "DOUGLAS®-ENZYME 3022," "DOUGLAS®-ENZYME 3023," "DOUGLAS®-ENZYME 3024," "DOUGLAS®-ENZYME E," "DOUGLAS®-ENZYME EC," "CROWN THIN BOILING X-10," "CROWN THIN BOILING X-18," "CROWN THIN BOILING XD," "CROWN THIN BOILING XF," "CROWN THIN BOILING XH," "CROWN THIN BOILING XJ," "CROWN THIN BOILING XL," "CROWN THIN BOILING XN," "CROWN THIN BOILING XP," "CROWN THIN BOILING XR," "DOUGLAS®-UNMODIFIED PEARL," and "DOUGLAS®-UNMODIFIED 1200." These sizing agents are all commercially available from Penford Products Co. "PENFORD®," "PENCOTE®," "PENSPRAE®," "PENGLOSS®," "APOLLO®," "ASTRO®," "ASTROCOTE®," "POLARIS®," "DOUGLAS®," and "CLEARSOL®" are all registered trademarks of Penford Products Co. Other suitable starches, including "SILVER MEDAL PEARL™," "PEARL B," "ENZO 32 D," ENZO 36W," ENZO 37D," SUPERFILM 245D," "SUPERFILM 270W," "SUPERFILM 240DW," "SUPERFILM 245D," SUPERFILM 270W," "SUPERFILM 280DW," "PERFORMER 1," "PERFORMER 2," "PERFORMER 3," "CALIBER 100," "CALIBER 110," "CALIBER 124," "CALIBER 130," "CALIBER 140," "CALIBER 150," "CALIBER 160," "CALIBER 170," "CHARGE +2," "CHARGE +4," "CHARGE +7," "CHARGE +9," "CHARGE +88," "CHARGE +99," "CHARGE +110," "FILMFLEX 40," "FILMFLEX 50," "FILMFLEX 60," and "FILMFLEX 70" are all commercially available from Cargill, Inc.

The cationic wet strength agent used in the manufacture of the paperboard can be selected from among those cationic wet strength agents known in the art such as dialdehyde starch, polyethylenimine, mannogalactan gum, glyoxal, and dialdehyde mannogalactan. A particularly useful class of wet strength agent is cationic glyoxylated vinylamide wet strength resins.

Glyoxylated vinylamide wet strength resins useful herein are described in U.S. Pat. No. 3,556,932 to Coscia. These resins are typically reaction products of glyoxal and preformed water soluble vinylamide polymers. Suitable polyvinylamides include those produced by copolymerizing a vinylamide and a cationic monomer such as 2-vinylpyridine, 2-vinyl-N-methylpyridinium chloride, diallyldimethyl ammonium chloride, etc. Reaction products of acrylamide diallyidimethyl ammonium chloride in a molar ratio of 99:1 to 75:25 glyoxal, and polymers of methacrylamide and 2-methyl-5-vinylpyridine in a molar ratio of 99:1 to 50:50, and reaction products of glyoxal and polymers of vinyl acetate, acrylamide and diallyldimethyl ammonium chloride in a molar ratio of 8:40:2 are more specific examples provided by Coscia. These vinylamide polymers may have a molecular weight up to 1,000,000, but polymers having molecular weights less than 25,000 are preferred. The vinylamide polymers are reacted with sufficient glyoxal to provide a water soluble thermoset resin. In most cases the molar ratio of glyoxal derived substituents to amide substitutes in the resin is at least 0.06:1 and most typically 0.1:1 to 0.2:1. A commercially available resin useful herein is Parez 631 NC sold by Cytec Industries.

The cationic wet strength agent is generally added to the paperboard web in an amount up to about 8 pounds per ton or 0.4 wt %. Generally, the cationic wet strength agent is provided by the manufacturer as an aqueous solution and is added to the pulp in an amount of about 0.05 to 0.4 wt % and more typically in an amount of about 0.1 to 0.2 wt %. Unless otherwise indicated, all weights and weight percentages are indicated herein on a dry basis. Depending on the nature of the resin, the pH of the pulp is adjusted prior to adding the resin. The manufacturer of the resin will usually recommend a pH range for use with the resin. The Parez 631NC resin can be used at a pH of about 4 to 8.

Other wet strength agents used in preparing the paperboards having a low benzene evolution at microwave conditions of this invention can be selected from among those aminoplast resins (e.g., urea-formaldehyde and melamine-formaldehyde) resins and those polyamine-epichlorohydrin, polyamine epichlorohydrin or polyamide-amine epichlorohydrin or polyamide-amine epichlorohydrin resins (collectively "PAE resins") conventionally used in the papermaking art. Representative examples of these resins are described throughout the literature. See, for example, *Wet Strength in Paper and Paperboard*, TAPPI Monograph Series No. 29, TAPPI Press (1952) John P. Weidner, Editor, Chapters 1, 2 and 3 and U.S. Pat. Nos. 2,345,543 (1944); 2,926,116 (1965); and 2,926,154 (1960). Typical examples of some commercially available resins include the PAE resins sold by Hercules under the name Kymene, e.g., Kymene 557H and by Georgia Pacific under the name Amres, e.g., Amres 8855.

Kymene type wet strength agent is added to the paper fiber in an amount up to about 8 pounds per ton or 0.4 wt % and typically about 0.01 to 0.2 wt % and still more typically about 1 to 2 pounds per ton or 0.5 to 0.1 wt %. The exact amount will depend on the nature of the fibers and the amount of wet strength required in the product. These resins are generally recommended for use within a predetermined pH range which will vary depending upon the nature of the resin. For example, the Amres resins are typically used at a pH of about 4.5 to 9. It should be understood that since the use of the paperboard of the invention having low benzene evolution will be used to make articles used in connection with food service, all the wet strength additives used to make articles for food service products should have FDA approval if the wet strength agents come into direct contact with the food products.

The binder used in the manufacture of the paperboard, optionally in conjunction with the pigment, is applied in the coating section. The aliphatic polymeric binder has been described herein above; and under microwave use conditions, e.g., at temperatures in excess of 430° F. evolves less than 0.04 milligrams of benzene per one square inch of the board coating surface. Advantageously the clay pigment may be any suitable clay known to the art. For example, suitable pigments include kaolin clay, engineered clays, delaminated clays, structured clays, calcined clays, alumina, silica, aluminosilicates, talc, zinc sulfide, bentonite, glass powder, calcium sulfate, ground calcium carbonates, precipitated calcium carbonates, barite, titanium dioxide, and hollow glass or organic spheres. These pigments may be used individually or in combination with other pigments. Preferably the clay is selected from the group consisting of kaolin clay and conventional delaminated pigment clay. A commercially available delaminated pigment clay is "HYDRAPRINT" slurry, supplied as a dispersion with a slurry solids content of about 68%. "HYDRAPRINT" is a trademark of Huber.

The pigment composition may also comprise other additives that are well known in the art to enhance the properties of coating compositions or are well known in the art to aid in the manufacturing process. For example, suitable additives include defoamers, antifoamers, dispersants, lubricants, film-formers, crosslinkers, thickeners and insolubilizers.

A suitable defoamer includes "Foamaster DF122NS" and "Foamaster VF." "Foamaster DF122NS" is a trademark of Henkel.

A suitable organic dispersant includes "DISPEX N-40" comprising a 40% solids dispersion of sodium polycarboxylate, "DISPEX N-40" is a trademark of Allied Colloids and Berchem® 4290; a complex organic dispersant; and Berchem® 4809, a polyacrylate dispersant supplied by Berchem Inc. Other suitable dispersants are Accumer® 9000 and Accumer® 9500, polyacrylate dispersants; Tamol® 731; Tamol® 850, a sodium salt of polymeric carboxylic acid; Tamol® 960, a sodium salt of a carboxylated acrylic polyelectrolyte; and Tamol® 983, an organic polyacid dispersant. The Tamol dispersants are supplied by the Rohm & Haas Company. Polyphosphates and hexametaphosphates are also suitable dispersants.

A suitable coating lubricant includes "BERCHEM 4095" which is a 100% active coating lubricant based on modified glycerides. "BERCHEM 4095" is a trademark of Berchem. Other suitable lubricants are Berchem® 4000, a polyethylene emulsion; Berchem® 4060, a polyethylene emulsion; Berchem® 4110; Berchem® 4113, a modified diglyceride; Berchem® 4300, a fatty acid dispersion; Berchem® 4320, a fatty acid dispersion; and Berchem® 4569, a diglyceride emulsion, all supplied by Bercen Inc. In addition, the following lubricants are utilized: HTI Lubricant 1000, calcium stearate; HTI Lubricant 1100, a calcium stearatelpolyethylene co-emulsion; and HTI Lubricant 1050, a polyethylenelcamauba wax co-emulsion supplied by Hopton Technologies, Inc.; and Sunkote® 455, calcium stearate supplied by Sequa Chemicals, Inc.

Suitable thickeners including the sodium alginate moiety are: Kelgin® LV, Kelgin® XL, Kelgin® RL, and Keigin® QL; SCOGIN™ QH, SCOGIN™ LV, and SCOGIN™ QL. Other suitable thickeners are propylene glycol alginates such as Kelcolloid® LVF; treated sodium alginates such as Kelgin® QM and Kelgin® QL. The Kelgin products are supplied by Merck & Co., Inc., and the Scogin products are supplied by Pronova Biopolymer, Inc.

The deposition of the mixture onto the wire may be referred to as web laydown and an embryonic paper web is formed thereby. The embryonic web comes off the screen and is carried on various fabrics or felts where it undergoes wet pressing by suitable papermaking apparatus known in the art. After wet pressing, the embryonic web is about 60% water and about 40% papermaking fiber and other solid material discussed previously.

The embryonic web then undergoes further drying processes, such as by means of vacuum boxes, through-air dryers, steam heated dryers, gas-fired dryers, or other suitable methods.

The paperboard useful for the manufacture of microwaveable containers of this invention can advantageously be produced under acid, alkaline or neutral sizing conditions. Suitable internal sizing agents include rosin and alum, waxes, fatty acid derivatives, hydrocarbon resins, alkyl ketene dimers, and alkenyl succinic anhydrides. Alkenyl succinic anhydrides are organic chemicals comprising an unsaturated hydrocarbon chain containing pendant succinic anhydride moiety. Monocarboxylic fatty acids having a chain length of $C_8$ to $C_{22}$ are also suitable internal sizing agents. The rosin sizing agents include gum rosin, wood rosin, and tall oil rosin. Suitable $C_8$ to $C_{22}$ fatty acids useful as internal sizing agents include coprylic, capric, lauric, myristic, palmitic, stearic, arachidic, betenic, palmitoleic, oleic, ricinoleic, petroselinic, vaccenic, linoleic, linolenic, eleostearic, licenic, paranirac, gadoleic, arachidonic, cetoleic, and erycic.

Alum or aluminum salts used to prepare suitable paperboards useful for the manufacture of microwaveable containers of this invention are water-soluble, and they may be aluminum sulfate, aluminum chloride, aluminum nitrate, or acid aluminum hydrophosphates in which P:Al=1.1:1–3:1.

When aluminum salts or their mixtures are used, a base is added to form aluminum hydroxide having anionic surface charges. The base used is suitably sodium or potassium hydroxide, sodium or potassium carbonate, sodium or potassium metasilicate, sodium or potassium watergasses, sodium or potassium phosphate or borate, or sodium or potassium aluminate, or mixtures of these.

Aluminate compounds such as sodium aluminate or potassium aluminate are also used as the water-soluble aluminum salts. In this case, acid is added in order to form, within the pH range 7–9, an aluminum hydroxide having anionic surface charges. The acid used is a mineral acid such as sulfuric acid, hydrochloric acid, nitric acid or phosphoric acid, or organic acids such as oxalic acid, citric acid or tartaric acid. Suitably the acids used may also be acid aluminum salts such as aluminum sulfate, aluminum chloride, aluminum nitrate, or various water-soluble aluminum hydrophosphates.

Suitably water-soluble polymeric aluminum salts, i.e., polyaluminum salts, so-called basic aluminum salts, which are also called polyaluminum hydroxy salts or aluminum hydroxy salts are also used. In addition, the following salts are utilized: polyaluminum sulfate, polyaluminum chloride and polyaluminum chloride sulfate. The polyaluminum salt does suitably, in addition to the chloride and/or sulfate ion, also contain other anions, e.g., phosphate, polyphosphate, silicate, citrate, oxalate, or several of these.

Commercially available polymeric aluminum salts of this type include PAC (polyaluminum chloride), PAS (polyaluminum sulfate), UPAX 6 (silicate-containing polyaluminum chloride), and PASS (polyaluminum sulfate silicate).

The net formula of the water-soluble polyaluminum salt may be, for example:

$$n[Al_2(OH)_m/Cl)_{6-m}]$$

and its alkalinity may vary so that the m-value ranges from 1 to 5 (alkalinity is respectively 16–83% according to the formula (m:6)×100). In this case the ratio Al/OH is 2:1–1:2.5. n is 2 or higher.

When a polyaluminum compound is used, it may be desirable to add a base in order to optimize the Al/OH ratio, even if all of the polyaluminum compounds in accordance with the invention do work as such.

The base or acid which forms in situ an aluminum hydroxide with the aluminum salt may be added to the fiber suspension, or just before the aluminum salt, or after it, or simultaneously with it.

The aluminum hydroxide may also be formed before the moment of addition, for example in the adding tube, or in advance in sol form.

The amount of the aluminum salt, calculated as $Al_2O_3$, is preferably approximately 0.01–1.0% of the dry weight of the pulp.

The following examples are intended to be illustrative of the present invention and to teach one of ordinary skill how to make use of the invention. These examples are not intended to limit the invention or its protection in any way.

EXAMPLES

Usually two coatings are applied to the wire side of the paperboard by the use of in-line blade coaters. The coated surface is then printed by conventional printing techniques. The microwave susceptor is then applied to the coated surface in a separate converting operation. These processes are set forth in FIGS. 15 and 16, numbers (70) to (87).

In one embodiment, only one side of the paperboard is coated. The coated side has coating No. 2 (described in Table 2) immediately adjacent the paperboard basestock. Coating No. 3 (described in Table 3) is applied on top of coating No. 2. The microwave susceptor is then applied to the top surface.

Alternatively, coating No. 1 (described in Table 1) is applied to one surface of the paperboard and coatings No. 2 and 3 are applied to the other surface. In this case the microwave susceptor is applied to either side of the coated surface.

TABLE 1

Composition of Coating No. 1

| Material | Parts |
|---|---|
| No. 1 Clay | 100.0 |
| Latex | 20.0 |
| Thickener | 0.5 |
| Ammonia | 0.3 |
| Dispersant | 0.1 |

TABLE 2

Composition of Coating No. 2

| Material | Parts |
|---|---|
| No. 2 Clay | 90.0 |
| Calcium carbonate | 10.0 |
| Latex | 19.3 |
| Thickener | 0.1 |
| Ammonia | 0.1 |
| Dispersant | 0.1 |

In both tables, the latexes were Rohm & Haas EXP 3368, Rohm and Haas Polyco 3103, BASF Acronal S-504, and Experimental latex from GenCorp. Rohm & Haas EXP 3368 is a copolymer that consists of 69% by weight poly(vinyl acetate) and 31% by weight poly(butyl acrylate) based on the quantitative carbon-13 NMR analysis. No other co-monomers were detected in this resin by C-13 NMR.

Table 3 shows that only the Rohm & Haas EXP 3368 and Rohm & Haas Polyco 3103 evolved less than 0.04 milligrams of benzene per square inch of board or container surface at a temperature in excess of 430° F.

TABLE 3

Composition of Coating No. 3

| | Benzene evolved at 430° F. $\mu$g/in.$^2$ |
|---|---|
| Styrene-butadiene Experimental latex from GenCorp | 0.700 |
| Styrene-acrylic-acrylonitrile copolymer (BASF Acronal S 504) | 0.180 |
| Rohm & Haas EXP 3368 | 0.011–0.020 |
| Rohm & Haas Polyco 3103 | 0.010 |

Using the alternate method where one side is coated with coatings 2 and 3 and the other side is coated with coating 1 produced the results shown in Table 4. The latex used in Table 4 was Rohm & Haas EXP 3368.

TABLE 4

| Reel No. | Coat Weight (#/3000 ft$^2$) T.S. | Coat Weight (#/3000 ft$^2$) W.S. | Benzene milligrams/in.$^2$ |
|---|---|---|---|
| 2242 (16 pt board) | 13.8 | 4.3 | 0.0094 |
| 2243 (16 pt board) | 14.6 | 3.8 | 0.0070 |
| 2244 (18 pt board) | 7.5 | 3.6 | 0.0087 |

W.S. = Wire Side; T.S. = Top Side of the board

I claim:

1. A microwaveable, food contact compatible, disposable, rigid and strong paperboard useful as a base stock for forming substantially high microwaveable food containers comprising:

(a) a sized paperboard blank having a basis weight suitable for a food container;

(b) a base coat coating applied to one or both surfaces of the paperboard blank, the base coat coating comprising a mixture of an inorganic pigment and an acrylic latex comprising aliphatic copolymers having the following monomers:

(i)

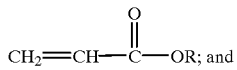

(ii)

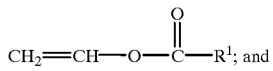

wherein R and $R^1$ may be the same or different aliphatic hydrocarbons having one to six carbon atoms and the ratio of (i) to (ii) is in the range of 1:100 to 100:1;

(c) a top coat coating layer applied to the base coat coating layer, the top coat coating layer comprising an inorganic pigment and an aliphatic polymer latex comprising aliphatic copolymers having the following monomers:

(i)

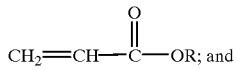

-continued (ii)

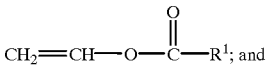

wherein R and $R^1$ may be the same or different aliphatic hydrocarbons having one to six carbon atoms and the ratio of (i) to (ii) is in the range of 1:100 to 100:1; and wherein said coated microwaveable paper board evolves less than 0.1 milligrams of benzene per square inch of the paperboard surface at temperatures in excess of 430° F. while exposed to microwave.

2. The paperboard of claim 1 wherein R and $R^1$ are —$CH_3$ groups and the paperboard evolves less than 0.04 milligrams of benzene per square inch of the paperboard surface at a temperature in excess of 430° F.

3. The paperboard of claim 1 or claim 2 wherein the base coat and the top coat are copolymer latex comprising comonomers of vinylacetate and butylacrylate.

4. The paperboard of claim 1 or claim 2 wherein the base coat and top coat are copolymer latex comprising comonomers of vinylacetate and acrylate.

5. The cellulosic paperboard of claim 1 or claim 2 wherein the paperboard is coated on one side with a metalized polyester to provide a food container with a microwave susceptor layer.

6. The cellulosic paperboard of claim 5 wherein the metal is aluminum.

7. The cellulosic paperboard of claim 5 wherein the metal is nickel.

8. The cellulosic paperboard of claim 5 wherein the metal coating is selected from the group consisting of aluminum, iron, nickel, copper, silver, carbon, stainless steel, nichrome, magnetite, zinc, tin, tungsten, titanium, and mixtures of these.

9. A microwaveable, food contact compatible, disposable, rigid and strong paperboard container comprising:

(a) a sized paperboard blank having a basis weight suitable for a food container;

(b) a base coat coating applied to one or both surfaces of the paperboard blank, the base coat coating comprising a mixture of an inorganic pigment and an acrylic latex comprising aliphatic copolymers having the following monomers:

(i)

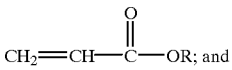

(ii)

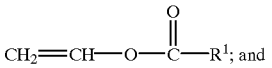

wherein R and $R^1$ may be the same or different aliphatic hydrocarbons having one to six carbon atoms and the ratio of (i) to (ii) is in the range of 1:100 to 100:1;

(c) a top coat coating layer applied to the base coat coating layer, the top coat coating layer comprising an inorganic pigment and an aliphatic polymer latex comprising aliphatic copolymers having the following monomers:

(i)

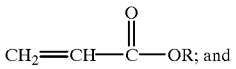

(ii)

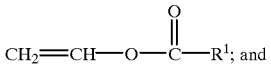

wherein R and $R^1$ may be the same or different aliphatic hydrocarbons having one to six carbon atoms and the ratio of (i) to (ii) is in the range of 1:100 to 100:1; and wherein said coated rigid microwaveable food container evolves less than 0.1 milligrams of benzene per square inch of the container surface at temperatures in excess of 430° F. while exposed to microwave.

10. The paperboard container of claim 9 wherein R and $R^1$ are —$CH_3$ groups and the paperboard container evolves less than 0.04 milligrams of benzene per square inch of the paperboard surface at a temperature in excess of 430° F.

11. The paperboard of claim 9 or claim 10 wherein the base coat and the top coat are copolymer latex comprising comonomers of vinylacetate and butylacrylate.

12. The paperboard of claim 9 or claim 10 wherein the base coat and top coat are copolymer latex comprising comonomers of vinylacetate and acrylate.

13. The paperboard of claim 9 or claim 10 wherein the base coat is a copolymer latex comprising vinylacetate and acrylate comonomers and the top coat is a copolymer latex comprising comonomers of vinylacetate and butylacrylate.

14. The paperboard of claim 9 or claim 10 wherein the base coat is a copolymer latex comprising comonomers of vinylacetate and butylacrylate and the top coat is a copolymer latex comprising vinylacetate and acrylate comonomers.

15. The cellulosic paperboard container of claim 9 or claim 10 wherein the paperboard container is coated on one side with a metalized polyester to provide a food container with a microwave susceptor layer.

16. The cellulosic paperboard container of claim 15 wherein the metal is aluminum.

17. The cellulosic paperboard container of claim 15 wherein the metal is nickel.

18. The container of claim 15 in which the paperboard blank has a weight in the range of about 100 to 400 lbs. per 3000 square foot ream and a caliper in the range of about 0.008 to 0.055 inch and the metal coating of the polyester is selected from the group consisting of aluminum, iron, nickel, copper, silver, carbon, stainless steel, nichrome, magnetite, zinc, tin, tungsten, titanium, and mixtures of these.

19. The container of claim 9 or claim 10 wherein the paper blank has a caliper in the range of about 0.008 to 0.050 inch.

20. The container of claim 9 or claim 10 in which sufficient moisture is introduced into the blank to produce a moisture content of about 4.0 to 12.0% by weight.

21. The microwaveable container of claim 15 in the form of a plate.

22. The microwaveable container of claim 18 in the form of a plate.

23. The microwaveable plate of claim 22 in the form of a compartmented plate.

24. The microwaveable container of claim 15 in the form of a bowl.

25. The microwaveable container of claim 18 in the form of a bowl.

26. The microwaveable container of claim 15 in the form of a canister.

27. The microwaveable container of claim 18 in the form of a canister.

28. The microwaveable container of claim 15 in the form of a rectangular take-out container.

29. A process for producing substantially rigid, microwaveable food containers from a coated paperboard comprising the steps of:

(a) sizing a paperboard suitable for use as a food container;

(b) applying a base coat coating to one or both surfaces of the paperboard blank, the base coat coating comprising a mixture of an inorganic pigment and an acrylic latex comprising aliphatic copolymers having the following monomers:

(i)

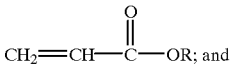

(ii)

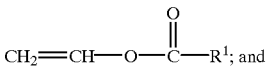

wherein R and $R^1$ may be the same or different aliphatic hydrocarbons having one to six carbon atoms and the ratio of (i) to (ii) is in the range of 1:100 to 100:1;

(c) applying a top coat coating layer to the base coat coating layer, the top coat coating layer comprising an inorganic pigment and an aliphatic polymer latex comprising aliphatic copolymers having the following monomers:

(i)

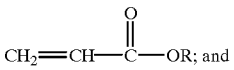

(ii)

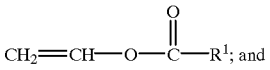

wherein R and $R^1$ may be the same or different aliphatic hydrocarbons having one to six carbon atoms and the ratio of (i) to (ii) is in the range of 1:100 to 100:1; and wherein said coated container at a temperature in excess of 430° F. evolves less than 0.1 milligrams of benzene per square inch of the board surface while exposed to microwave.

30. The process of claim 29 wherein R and $R^1$ are —$CH_3$ groups and the paperboard container evolves less than 0.04 milligrams of benzene per square inch of the container surface at a temperature in excess of 430° F.

31. The process of claim 29 or claim 30 wherein the base coat and top coat are copolymer latex comprising comonomers of vinylacetate and butylacrylate.

32. The process of claim 29 or claim 30 wherein the base coat and top coat are copolymer latex comprising comonomers of vinylacetate and acrylate.

33. The process of claim 29 or claim 30 wherein the base coat is a copolymer latex comprising vinylacetate and acrylate comonomers and the top coat is a copolymer latex comprising comonomers of vinylacetate and butylacrylate.

34. The paperboard of claim 29 or claim 30 wherein the base coat is a copolymer latex comprising comonomers of vinylacetate and butylacrylate and the top coat is a copolymer latex comprising vinylacetate and acrylate comonomers.

35. The process of claim 29 or claim 30 in which the weight of the paperboard blank is controlled within the range of about 100 to 400 lbs. per 3000 square foot ream and the caliper is controlled to be in the range of about 0.008 to 0.055 inch.

36. The process of claim 35 wherein the caliper of the paper blank is controlled to be in the range of about 0.008 to 0.050 inch.

37. The process of claim 36 comprising introducing a controlled amount of moisture into the blank to produce a moisture content of about 4.0 to 12.0% by weight.

38. The process of claim 29 or claim 30 wherein the paperboard container is coated on one side with a metalized polyester to provide a food container with a microwave susceptor layer.

39. The process of claim 38 wherein the metal is aluminum.

40. The process of claim 38 wherein the metal is nickel.

41. The process of claim 38 wherein the metal coating is selected from the group consisting of aluminum, iron, nickel, copper, silver, carbon, stainless steel, nichrome, magnetite, zinc, tin, tungsten, titanium and mixtures of these.

42. The paperboard of claim 1 or claim 2 wherein the paperboard evolves less than 0.03 milligrams of benzene per square inch of the board surface at a temperature in excess of 430° F.

43. The paperboard of claim 1 or claim 2 wherein the paperboard evolves less than 0.02 milligrams of benzene per square inch of the board surface at a temperature in excess of 430° F.

44. The paperboard of claim 1 or claim 2 wherein the paperboard evolves less than 0.01 milligrams of benzene per square inch of the board surface at a temperature in excess of 430° F.

45. The paperboard container of claim 9 or claim 10 wherein the paperboard container evolves less than 0.03 milligrams of benzene per square inch of the paperboard container surface at a temperature in excess of 430° F.

46. The paperboard container of claim 9 or claim 10 wherein the paperboard container evolves less than 0.02 milligrams of benzene per square inch of the paperboard container surface at a temperature in excess of 430° F.

47. The paperboard container of claim 9 or claim 10 wherein the paperboard container evolves less than 0.01 milligrams of benzene per square inch of the paperboard container surface at a temperature in excess of 430° F.

* * * * *